US008147340B2

(12) United States Patent
Brunet de Courssou et al.

(10) Patent No.: US 8,147,340 B2
(45) Date of Patent: Apr. 3, 2012

(54) METHODS AND REGULATED GAMING MACHINES CONFIGURED FOR SERVICE ORIENTED SMART DISPLAY BUTTONS

(75) Inventors: Thierry Brunet de Courssou, Missilac (FR); Cameron Anthony Filipour, Las Vegas, NV (US)

(73) Assignee: IGT, Reno, NV (US)

( * ) Notice: Subject to any disclaimer, the term of this patent is extended or adjusted under 35 U.S.C. 154(b) by 471 days.

(21) Appl. No.: 12/398,824

(22) Filed: Mar. 5, 2009

(65) Prior Publication Data

US 2010/0227690 A1 Sep. 9, 2010

(51) Int. Cl.
*A63F 9/24* (2006.01)

(52) U.S. Cl. ..... 463/42

(58) Field of Classification Search ..... 463/42
See application file for complete search history.

(56) References Cited

U.S. PATENT DOCUMENTS

| | | | | |
|---|---|---|---|---|
| 4,078,257 | A | 3/1978 | Bagley | |
| 4,897,651 | A | 1/1990 | DeMonte | |
| 5,278,362 | A | 1/1994 | Ohashi | |
| 5,314,505 | A | 5/1994 | Chan et al. | |
| 5,818,361 | A | 10/1998 | Acevedo | |
| 6,102,394 | A | 8/2000 | Wurz et al. | |
| 6,227,970 | B1 * | 5/2001 | Shimizu et al. | 463/20 |
| 6,310,308 | B1 | 10/2001 | Watson et al. | |
| 6,454,649 | B1 | 9/2002 | Mattice et al. | |
| 6,798,359 | B1 | 9/2004 | Ivancic | |
| 6,908,391 | B2 | 6/2005 | Gatto et al. | |
| 6,916,247 | B2 | 7/2005 | Gatto et al. | |
| 6,945,870 | B2 | 9/2005 | Gatto et al. | |
| 7,060,922 | B2 | 6/2006 | Hoehne et al. | |
| 7,071,845 | B2 | 7/2006 | Ivancic | |
| 7,297,062 | B2 | 11/2007 | Gatto et al. | |

(Continued)

FOREIGN PATENT DOCUMENTS

GB 2354090 3/2001

(Continued)

OTHER PUBLICATIONS

Itunes 7 Cover Flow Web page "Great Cover version", downloaded from http://www.apple.com/itunes/jukebox/coverflow.html on Aug. 22, 2008, copyright 2008, Apple, Inc.

(Continued)

*Primary Examiner* — N Drew Richards
*Assistant Examiner* — Yu-Hsi D Sun
(74) *Attorney, Agent, or Firm* — Clise, Billion & Cyr, P.A.; Richard E. Billion; Timothy Clise

(57) ABSTRACT

A regulated gaming system includes a plurality of computer nodes communicating over a network. At least one of the computer nodes includes a gaming machine, which may include a game controller and an interactivity apparatus to accept wagers from a player and to provide random outcomes while playing a game. The interactivity apparatus may include one or more video displays; a menu of available player-selectable games and one or more option buttons, the function of which changes depending upon which of the player-selectable games is selected by the player. A non-video display is associated with each option button, and is configured to indicate the status and/or the function thereof. The gaming machine includes a non-video services subscriber configured to receive, over the network, selected non-video display services to which the non-video services subscriber has subscribed from a non-video display services provider executing in one or more of the computer nodes.

34 Claims, 25 Drawing Sheets

U.S. PATENT DOCUMENTS

| | | | | |
|---|---|---|---|---|
| 7,301,532 | B1 | 11/2007 | Dobry | |
| 7,479,949 | B2 | 1/2009 | Jobs et al. | |
| 2002/0086728 | A1 | 7/2002 | Bennett et al. | |
| 2003/0004961 | A1 | 1/2003 | Slothouber et al. | |
| 2003/0100369 | A1 | 5/2003 | Gatto et al. | |
| 2003/0100370 | A1 | 5/2003 | Gatto et al. | |
| 2003/0100371 | A1 | 5/2003 | Gatto et al. | |
| 2003/0100372 | A1 | 5/2003 | Gatto et al. | |
| 2004/0102244 | A1 | 5/2004 | Kryuchkov et al. | |
| 2004/0106443 | A1 | 6/2004 | Fiden | |
| 2005/0233811 | A1 | 10/2005 | Gatto et al. | |
| 2005/0261060 | A1 | 11/2005 | Nguyen et al. | |
| 2005/0261061 | A1 | 11/2005 | Nguyen et al. | |
| 2006/0116207 | A1 | 6/2006 | DeLeon | |
| 2007/0060312 | A1 | 3/2007 | Dempsey et al. | |
| 2007/0111787 | A1 | 5/2007 | Adams et al. | |
| 2007/0185776 | A1 | 8/2007 | Nguyen et al. | |
| 2007/0191102 | A1 | 8/2007 | Coliz et al. | |
| 2007/0243925 | A1 | 10/2007 | LeMay | |
| 2007/0293323 | A1 | 12/2007 | Gatto et al. | |
| 2008/0032801 | A1 | 2/2008 | Brunet de Courssou | |
| 2008/0102916 | A1 | 5/2008 | Kovacs et al. | |
| 2008/0168401 | A1 | 7/2008 | Boule et al. | |
| 2010/0227690 | A1* | 9/2010 | Brunet De Courssou et al. | 463/42 |

FOREIGN PATENT DOCUMENTS

| | | | |
|---|---|---|---|
| WO | 2007/098035 | A2 | 8/2007 |
| WO | 2007098035 | A2 | 8/2007 |
| WO | 2009062124 | A1 | 5/2009 |
| WO | 2009111514 | A2 | 9/2009 |

OTHER PUBLICATIONS

What if Gmaing Went to a Hosted, Subscription Model, Rob Enderle, Jul. 22, 2008, copyright 2008 Digital Trend.

United Keys "Keyboards", printed on Jun. 9, 2008 from http://www.unitedkeys.com/index.html Copyright 20087 United Keys, Inc.

United Keys "What are display keys" Keyboards, printed on Jun. 9, 2008 from http://www.unitedkeys.com/index.html Copyright 20087 United Keys, Inc.

United Keys "Enable", printed on Jun. 9, 2008 from http://www.unitedkeys.com/index.html Copyright 20087 United Keys, Inc.

Coin Mechanisms, Inc., Gamesman Products/Programmable Player Interface (PPI)/OLED Button Development Kit, printed on Jun. 9, 2008 from http://www.unitedkeys.com/index.html Copyright 20087 United Keys, Inc.

Coin Mechanisms, Inc., New Products Programmable and Downlaodable Slot Button Panel, printed on Jun. 9, 2008 from http://www.unitedkeys.com/index.html Copyright 20087 United Keys, Inc.

Optimus Maximus Keyboard web site, http //artlebedev/everything/optimus, printed on Jun. 9, 2008.

Patents and Keyboard: a Lithe History, LiVEJOURNAL web site http://community.livejournal.com/optimus_project/52831,html, printed on Mar. 25, 2008.

Medison Celebrity: Scam or Just a Bad Idea?; blog of Jan. 26, 2008, at http://www/medisonscam.info/2008/01/united-keys-valdis-imagionary-keyboard.html, printed on Mar. 25, 2008.

Life and Incredible Adventures of Optimus Keyboards, printed on Mar. 25, 2008 from http://community.livejournal.com/optimus_project.

Gamesman Ltd Push Buttons Series 100-900, printed from http://www.gamesman.co.uk/ on Feb. 13, 2009.

Coin Mechanisms, Inc. GPB930 "Fireball" push button Product Card, downloaded from http://www.coinmech.com/image_page.cfm?id=1422&mediatype=dd on Feb. 13, 2009.

International Preliminary Examination Report of Mar. 4, 2010 in related PCT application PCT/US2008/073559.

ISR and WO of Dec. 3, 2009 in related PCT application PCT/US2009/060331.

International Search Report and Written Opinion of Dec. 10, 2009 in PCT application PCT/US2009/060322.

International Search Report and Written Opinion of Dec. 30 2009 in related application PCT/US 09/60313.

Non-Final Office Action of Jun. 7, 2011 in related U.S. Appl. No. 12/398,843.

* cited by examiner

METHODS AND REGULATED GAMING MACHINES CONFIGURED FOR SERVICE ORIENTED SMART DISPLAY BUTTONS

CROSS-REFERENCE TO RELATED APPLICATIONS

The present application is related in subject matter to Ser. No. 12/398,843 entitled "Methods And Regulated Gaming Machines Including Service Oriented Blades Configured To Enable Player Interaction Via A Touch-Screen Display" and to Ser. No. 12/398,867 entitled "Methods And Regulated Gaming Machines Including Game Gadgets Configured For Player Interaction Using Service Oriented Subscribers And Providers", both filed on even date herewith, which applications are hereby incorporated herein by reference in their entireties.

BACKGROUND OF THE INVENTION

1. Field of the Invention

Embodiments of the present inventions relate generally to the field of pay computer-controlled games and entertainment devices, including both games of skills and games of chance. More particularly, embodiments of the present inventions relate the field of methods, systems and devices for the automated monitoring and control of a large number of clusters of such pay gaming and entertainment devices.

2. Description of the Related Art

Conventional pay entertainment and gaming systems, either of the cash or the cash-less type, are seriously limited due to the technical choices that are typically made to comply with regulatory requirements. Indeed, regulators are mainly concerned with fraud, cheating and stealing, as may occur when legitimate winners are deprived of their just winnings or when illegitimate users receive illegitimate winnings. Because of these security concerns, regulators are reluctant to approve licenses for state-of-the-art "open" multimedia and Internet technologies, opting instead for known but antiquated technology.

However, the security of such antiquated technology (i.e., technology developed prior to the present advanced multimedia and Internet age) is mostly illusory. Such conventional technologies are only perceived as being more stable and secure because their flaws are not widely publicized. Computer technology being extremely complex, there are always latent imperfections and flaws, which may be exploited by the ill intentioned. This is even truer with antiquated technology, as hacker-crackers have now access to considerable information on software weaknesses as well as sophisticated attack strategies and tools that they may apply to older software.

Legacy entertainment and gaming systems that are authorized for use in public places are usually aggregates of old technologies bundled together with some PC hardware featuring basic fault tolerance, basic data integrity and ad-hoc security means, together with some LAN networking functionality to enable some primitive centralized auditing. Although some advanced security means have been proposed (such as disclosed in, for example WO 01/41892) that promote off-line gaming security using smart cards, this approach in fact exposes the system to latent unidentified security threats that hacker-crackers or employees will likely eventually exploit. Off-line or semi-on-line systems are totally in the hands of very few people. In short, these systems operate essentially with little means for detecting under-the-radar fraud (to push the analogy farther, finer-grained and smarter radar means would be uneconomical for casino and gaming operators to implement).

In contrast, lottery and pari-mutual wager systems have evolved to modern fully on-line very-high-capacity mission-critical systems tunneling billions of dollars annually while offering significantly greater security means than the security afforded by banks. Since these organizations have come on-line, lawsuits resulting from complaints, flaws and fraud, including internal fraud by employees, have virtually disappeared. However, although pay entertainment and gaming machines based on secure Internet web browser and cash-less payment technology are ideal centralized candidate solutions to equip casinos and like sites, these may rapidly kill the traditional gaming support industry.

The entertainment and gaming systems lag behind state-of-the-art multimedia PC, gaming console, wireless and interactive TV technologies; consequently these systems are ill prepared to attract the younger player generation accustomed to flashy and networked games.

SUMMARY OF THE INVENTION

An embodiment of the present invention is a regulated gaming system including a plurality of computer nodes communicating over a network. At least one of the plurality of computer nodes includes a gaming machine, which may include a game controller and an interactivity apparatus to accept wagers from a player and to provide random outcomes while playing a game, the interactivity apparatus including at least one video display; a menu of available player-selectable games; at least one option button, a function of each option button changing depending upon which of the player-selectable games is selected by the player; a non-video display associated with each option button, the non-video display being configured to indicate at least one of a status and a function of the associated option button, and a non-video services subscriber configured to receive, over the network, selected non-video display services to which the non-video services subscriber has subscribed from a non-video display services provider executing in at least one of the plurality of nodes.

The non-video display may be configured for data refresh rates of less than about 15 data refreshes per second. The non-video display provider may be further configured to consume non-video display services from the non-video services subscriber over the computer network and to control the non-video display in accordance with the consumed non-video display services. Operation of the non-video display may be independent of an activation of the option button. The gaming machine further may include an interactive control services subscriber and an interactive control services provider executes in at least one of the plurality of nodes to provide selected interactive control services to and control the interactive control services subscriber over the network. The interactive control services subscriber may be independent of the non-video services subscriber. A high level module may be provided that is coupled to the interactive control services subscriber and to the non-video services subscriber such that activation of the option button causes the interactive control services subscriber to communicate with the non-video services subscriber via the high level module and the non-video display services provider to consume non-video display services from the non-video services subscriber and to control the non-video display to update according to the consumed non-video display services. The interactive control services subscriber and the non-video services subscriber may be combined into an interactive control and non-video services subscriber, and the non-video display services provider and the interactive control services provider may be combined into an interactive control and non-video display services provider that may be coupled to the single interactive control and non-video services subscriber over the network.

The non-video display may be disposed at least partially above the option button. The non-video display may include an organic light emitting diode (OLED). The option button may be configured to be controlled by the game controller. The option button may include a button housing and a button plunger, and the non-video display may be not attached to the button housing and may be not attached to the button plunger. The option button may include a button plunger, and the non-video display may be attached to the button plunger. The gaming machine may include a front panel plate and the non-video display may be attached to the front panel plate. The option button may be disposed at least partially over the non-video display and may include an at least partially transparent portion such that the non-video display is viewable therethrough. The non-video display services provider may be coupled to the front panel plate. The gaming machine may include a front panel plate and the option button may include leg portions configured to extend through openings defined in the front panel plate. The option button may include a top portion that is at least partially transparent and the non-video display may be coupled to an underside of the top portion such that the non-video display is viewable therethrough. At least one of a function and a status of the option button may be also configured to change dining game play of the game selected by the player. The interactive control service provider may include all necessary computer, electronics and software to provide and consume the interactive control services to and from the interactive control services subscriber. The interactive control service provider may be configured to provide and consume the interactive control services independently of the game controller of the gaming machine. The non-video display services provider may include all necessary computer, electronics and software to provide and consume the non-video display services to the non-video services subscriber. The non-video display services provider may be configured to provide and consume the non-video display services independently of the game controller of the gaming machine.

According to another embodiment thereof, the present invention is a method that includes steps of providing a gaming machine in a regulated gaming system including a plurality of computer nodes communicating over a network, the gaming machine comprising: a game controller and interactivity apparatus to accept wagers from a player and to provide random outcomes while playing a game, the interactivity apparatus including at least one video display; a menu of available player-selectable games; at least one option button, and a non-video display associated with each, option button, the non-video display being configured to indicate at least one of a status and a function of the associated option button; steps of receiving a selection, from the menu of available player-selectable games, of a game from the player; setting the function of each option button depending upon the game selected by the player, providing non-video display services over the network to a non-video display services subscriber executing in one of the plurality of computer nodes; subscribing to non-video display services provided by a non-video display services provider executing in one of the plurality of computer nodes; consuming non-video display services provided by the non-video services provider over the network, and controlling the non-video display to display at least one of a status and the set function according to the consumed non-video display services provided by the non-video services provider.

The providing step may be carried out with the non-video display being configured for data refresh rates of less than about 15 data refreshes per second. The providing step may be carried out with an operation of the non-video display being independent of an activation of the option button. A step may be provided of providing, inside the gaming machine, an interactive control services provider configured to control selected ones of the option buttons and to provide interactive control services over the network to an interactive control services subscriber executing in one of the plurality of computer nodes; and the option button function setting step may include: subscribing to interactive control services provided by the interactive control services provider; providing interactive control services to the interactive control services subscriber; consuming interactive control services provided by the interactive control services provider, and setting at least one of the function and status of the option button according to the consumed interactive control services. The interactive control services subscriber providing step and the non-video services subscriber providing step may be carried out such that the interactive control services subscriber is independent of the non-video services subscriber. A step may be carried out of monitoring an activation state of the option button and, upon detecting that the option button has been activated, providing, by the interactive control services provider inside the gaming machine, interactive control services to the interactive control services subscriber executing in one of the plurality of computer nodes, indicating that the option button has been activated, and causing the interactive control services subscriber to communicate with the non-video services subscriber and the non-video services subscriber to consume non-video display services of the gaming machine to cause the non-video display provider to control the non-video display to update in accordance with the consumed non-video display services. The gaming machine providing step may be carried out with the non-video display being disposed at least partially above the option button. The gaming machine providing step may be carried out with the non-video display including an organic light emitting diode (OLED). The gaming machine providing step may be carried out with the option button including a button housing and a button plunger, and with the non-video display being unattached to the button housing and unattached to the button plunger. The gaming machine providing step may be carried out with the option button including a button plunger, and with the non-video display being attached to the button plunger. The gaming machine providing step may be carried out with the gaming machine including a front panel plate, with the non-video display being attached to the front panel plate, and with the option button being disposed at least partially over the non-video display and including an at least partially transparent portion such mat the non-video display may be viewable therethrough. The gaming machine providing step may be carried out with the gaming machine including a front panel plate and with the option button comprising leg portions that are configured to extend through openings defined in the front panel plate, the option button including a top portion that may be at least partially transparent and with the non-video display being coupled to an underside of the top portion such that the non-video display may be viewable therethrough. A step of changing the function of the option button during game play of the game selected by the player may be carried out. The option button function setting step may be carried out by an interactive control service provider mat may include all necessary computer, electronics and software to provide and consume the interactive control services to and from the interactive control services subscriber. The option button function setting step may be carried out with the interactive control service provider being configured to provide and consume the interactive control services independently of a controller of the gaming machine. The non-video display services providing step, the subscribing step, the consuming step and the controlling step may be carried out by a non-video display services provider that may include all necessary computer, electronics and software to subscribe to, provide and consume the non-video display services to and from the non-video services subscriber. The non-video display services provider may be configured to subscribe to, provide and consume the non-video display services independently of a controller of the gaming machine.

A still further embodiment of the present invention is a gaming machine mat may include a game controller and an interactivity apparatus to accept wagers from a player and to provide random outcomes while playing a game, the interactivity apparatus including at least one video display; a menu of available player-selectable games; a front panel plate; an option button, the option button including a button housing and a button plunger, a function of the option button being configured to change depending upon which of the player-selectable games may be selected by the player, and a non-video display coupled to the front panel plate, the non-video display being configured to indicate at least one of a status and a function of the option button, the option button being disposed at least partially over the non-video display and including an at least partially transparent portion such that the non-video display may be viewable therethrough, the non-video display being unattached to the button housing and to the button plunger.

The non-video display may be configured for data refresh rates of less than about 15 data refreshes per second. Operation of the non-video display may be independent of an activation of the option button. The non-video display may include an organic light emitting diode (OLED). The option button may be configured to be controlled by the game controller. The option button may include a button plunger, and the non-video display may be attached to the button plunger. The front panel plate may define openings therethrough, and the option button may include leg portions that extend through the openings. The non-video display may be coupled to an underside of the at least partially transparent portion. The function and/or the status of the option button may be also configured to change during game play of the game selected by the player.

BRIEF DESCRIPTION OF THE DRAWINGS

FIG. 1*b* illustrates a gaming machine that includes a plurality of additional non-video displays to provide the player with additional information, according to embodiments of the present inventions.

DETAILED DESCRIPTION OF THE INVENTION

Figure 1A:
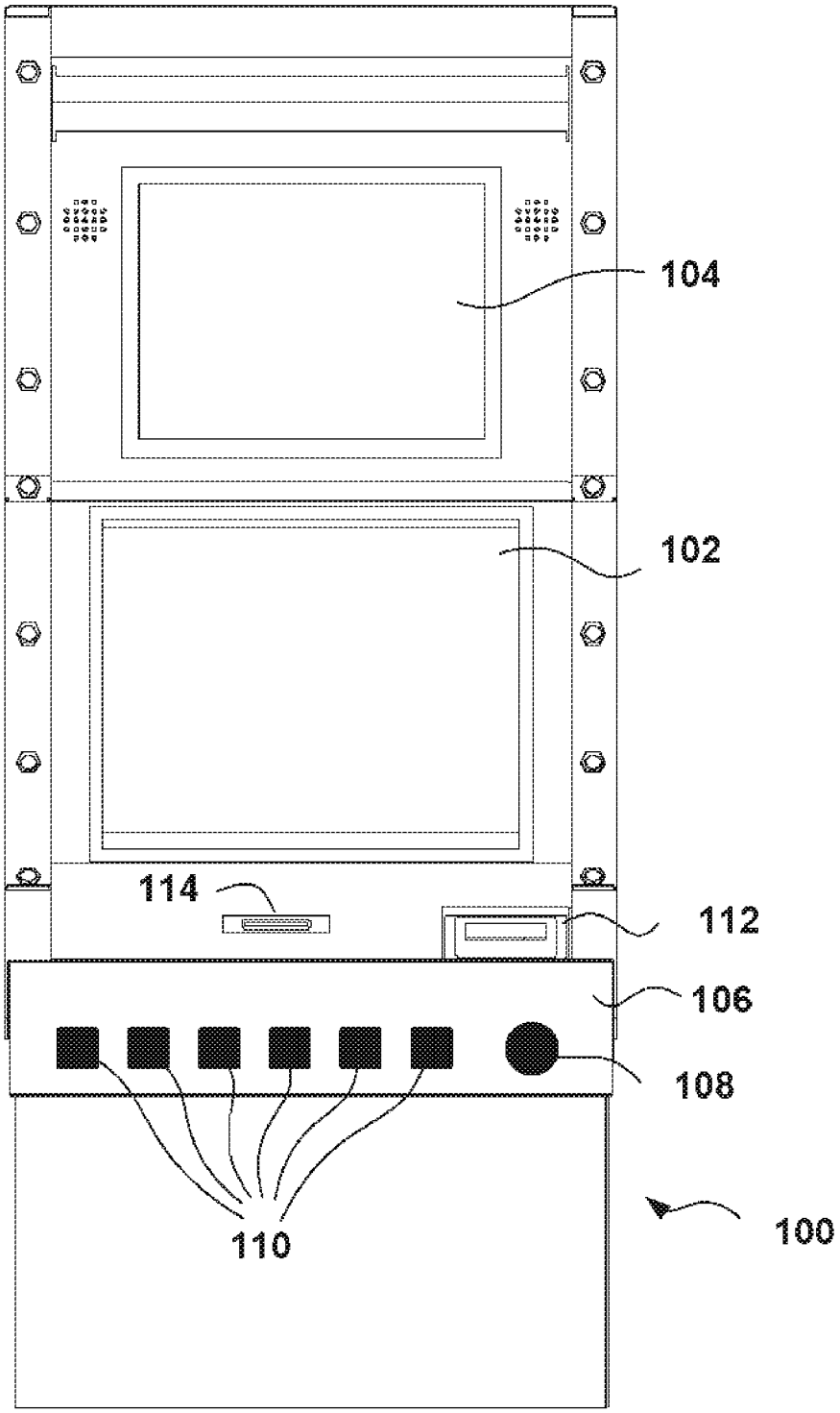
FIG. 1a (Prior Art)
FIG. 1*a* illustrates a conventional gaming machine that includes a BET button and six option buttons whose function depend on the game being played.

Reference will now be made in detail to the construction and operation of preferred implementations of the present inventions illustrated in the accompanying drawings. The following description of the preferred implementations of the present inventions is only exemplary of the inventions. Embodiments of the present inventions are not limited to these implementations, but may be realized by other implementations.

Portions of the detailed description mat follows describe processes and symbolic representations of operations by computing devices that may include conventional computer components, including a local processing unit, memory storage devices for the local processing unit, display devices, and input devices. Furthermore, such processes and operations may utilize conventional computer components in a heterogeneous distributed computing environment including, for example, remote file servers, computer servers, and memory storage devices. These distributed computing components may be accessible to the local processing unit by a communication network.

The processes and operations performed by the computer include the manipulation of data bits and transformation of signals by a local processing unit and/or remote server and the maintenance of these bits within data structures resident in one or more of the local or remote memory storage devices. These data structures impose a physical organization upon the collection of data bits stored within a memory storage device and represent electromagnetic spectrum elements.

A process may generally be defined as being a sequence of computer-executed steps leading to a desired result. These steps generally require physical manipulations of physical quantities. Usually, though not necessarily, these quantities may take the form of electrical, magnetic, or optical signals capable of being stored, transferred, combined, compared, or otherwise manipulated. It is conventional for those skilled in the art to refer to these signals as bits or bytes (when they have binary logic levels), pixel values, works, values, elements, symbols, characters, terms, numbers, points, records, objects, images, files, directories, subdirectories, services provided or consumed over a computer network and the like. It should be kept in mind, however, that these and similar terms should be associated with appropriate physical quantities for computer operations, and that these terms are merely conventional labels applied to physical quantities that exist within and that are transformed within the computer, during operation thereof.

It should also be understood that manipulations within the computer are often referred to in terms such as adding, comparing, moving, positioning, placing, illuminating, removing, altering, etc., which could be associated with manual operations performed by a human operator. The operations described herein, however, are machine operations performed in conjunction with various inputs provided by another computer or provided by a human operator or user that interacts with the computer. The machines used for performing the operation of the present invention (such as the gaming machines disclosed herein) may include local or remote general-purpose digital computers, custom-built controllers or other similar computing devices.

In addition, it should be understood that the programs, processes, methods, etc. described herein need not be related or limited to any particular computer or apparatus nor need they be related or limited to any particular communication network architecture. Rather, various types of general-purpose machines may be used with program modules constructed in accordance with the teachings described herein. Similarly, it may prove advantageous to construct a specialized apparatus to perform the method steps described herein by way of dedicated computer systems in a specific network architecture with hard-wired logic or programs stored in non-volatile memory, such as read only memory.

Video displays are usually characterized by their ability to render continuously moving images on a surface by illumination means driven from an electronic controller at a rate between 15 and 100 frames or images per second. The illumination means are well known in the art of video displays (e.g., CRT, LCD, projection LCD, OLED, plasma display, DLP, OLED TV, etc.). The image rendering is fed by a continuous stream of video data in compressed or non-compressed format (e.g. AVI, mp4, mov, TV channel via cable modem or satellite, etc.). Cartoon animations and low quality steaming video may be rendered at 10 to 15 images per second (or an approaching frame rate). Television is typically rendered at 30 images per second in countries having 60 Hz AC mains, and at 25 images per second in countries having 50 Hz AC mains. Cinematographic films converted to DVD or HD-DVD (e.g., Blu-ray®) may be rendered at other display rates such as, for example, 24 images per second. Well known interlacing and progressive scanning techniques may be used, but are not further discussed herein. Game consoles may render the game video at frame rates of up to 100 images per second because of the need to fluidly render fast moving action sequences. Video displays (e.g., a LCD monitor) connected to computers and game consoles comprise a fast video frame memory buffer that is continually addressed to refresh the rendering of the video image and avoid or minimize image flickering. The rendering refresh rate may range from 30 to 100 image refreshes per second. However, although the video frame memory buffer is capable of accepting image updates from the controlling PC or game console at the same frame or image rate as the rendering refresh rate, the video frame memory buffer need not be updated by the controlling PC or game console that often, and generally the update (from the PC) is done only when a portion of the image has changed, and only for the region of the buffer memory that stores the changed portion of the image. When the PC or the game console streams some video data in full screen, for example when viewing a movie from a DVD or a Blu-ray® disk, then the video frame memory buffer is continually updated by the PC or game console at the movie frame rate.

Non-video displays are usually characterized by their ability to render luminous indications or indicia that change infrequently, typically at rates that are less than 15 times per second. An airport plasma screen displaying departure and arrival flight details may be considered as a non-video display (although the rendering refresh frame rate from the associated video frame memory buffer is much higher). Such non-video displays are fed with digital information to be rendered only when the digital information changes. The non-video displays using decaying illumination phosphorescence (e.g. CRT) and other beam line scanning means may need to be refreshed periodically from an image frame buffer memory even when the digital information does not change, to prevent the displayed image from fading. The refresh rate from the image frame buffer memory may be higher than 15 frames per second to ensure a steady, non-flickering image; however, the digital information to be rendered may change less frequently (e.g. 15 times per second, 1 time per second, once every minute, once every hour, etc.).

The technology of non-video displays has evolved from on/off signal indicators (e.g. a filament lamp, a LED), color signal indicators (e.g. changing from red to green, and vice-versa), numerical and alpha-numerical digital indicators (e.g. seven-segment LEDs, nixie vacuum tubes, VFD vacuum fluorescent displays, fourteen-segment displays, sixteen-segment displays, dot matrix screens, LCD indicators, laser scan displays, retinal scan displays, monochrome OLEDs, etc.), and color digital indicators (Red/Blue/Green LEDs, color VFDs, color LCDs, color LEDs, color OLED). Non-video displays range from very small sizes to huge street bill-board sizes, with low to very high densities of controlled picture elements (i.e., pixels). A mixture of non-video display technologies may be used, for example in the glass and the table of pinball machines, or in the cockpit of an aircraft.

Casino gaming machines may advantageously configured to use both the video displays technologies and the non-video display technologies described in the previous paragraphs, in accordance with a modular specialized device architecture, in a tightly coupled or loosely coupled communication model. The service oriented model described may be applied to the video displays and non-video displays.

The present gaming machine may also include one or more player video displays driven directly by a multimedia controller within the gaming machine or driven externally thereto, one or more non-video displays such as status indicators, digital indicators, mechanical indicators, blinking lights illuminations and the like and one or more player interactive controls such as a one-arm bandit handle, push-buttons, trackballs or a joystick. For example, the payment and identification devices of the present gaming machines may include a coin acceptor, a coin dispenser or hopper, a bill or note acceptor, a bill dispenser, a smart card reader and writer, a smart card dispenser, a bar or oilier machine readable code reader, a ticket printer, a magnetic card reader, a biometric ID reader and/or other devices. Such a configuration is merely presented herein for illustrative purposes and is not intended to limit embodiments of the present inventions to any one particular configuration.

Specialized devices may include, for example, a gaming machine's video and non-video displays, payment-related devices and identification devices. The gaming machine's random number generator may also be a specialized device. For example, a gaming machine may only be configured for cash-less payment using voice ID; in that case, only specialized devices in the form of a microphone and touch-screen (and/or display and keypad) need be present. Moreover, the list of specialized devices above is not limitative, as new specialized devices may become available such as interfaces with personal wallets, contact-less smart cards or ID tokens, for example. Any such specialized devices may readily be incorporated within the present gaming machines. It is to be noted that the purpose for listing a significant number of specialized devices is not to recommend equipping gaming machine with each listed specialized device, but rather to teach the benefits of designed-in modularity.

In legacy gaming machines, the connection between specialized devices and the processing hardware is rather ad-hoc, as a wide variety of interfaces are encountered such as RS232, RS422, Parallel, via dedicated add-on board, etc. More recent specialized devices are now capable of providing a Universal Serial Bus ("USB") interface. However, all of these devices require that special software (software device drivers) that understands the inner characteristics of the hardware be developed. Software device drivers are well known to be difficult to develop and to introduce computer instabilities and limitations, especially when there is a large number of devices that may give rise to resource sharing conflicts. According to embodiments of the present invention, specialized devices may be configured to possess the necessary embedded processing resources to control the entire operation of the device and to communicate with high-level application software via a clearly defined Application Program Interface or API.

According to embodiments of the present inventions, gaming machine specialized devices that include video displays and/or gaming machine specialized devices that include non-video displays may advantageously be aggregated such as to present only one coupling interface and become one specialized device. Similarly, the specialized devices having video displays, the specialized devices having non-video displays and the specialized devices having player interactive controls may be aggregated such as to present only one coupling interface and become one specialized device. Likewise, the hardware of the specialized devices having non-video displays and the specialized devices having player interactive controls may be aggregated such as to present only one coupling interface and become one specialized device.

FIG. 1*a* illustrates a conventional gaming machine 100 that may include a main video display 102, a top video display 104, a front panel 106, a bill/ticket acceptor 112 and a ticket printer 114. The front panel 106 may include a BET button 108 and six option buttons 110 whose function depend on the game being played (and whose function may also change during game play of the game selected by the player).

FIG. 1*b* illustrates a gaming machine that includes a plurality of additional non-video displays to provide the player with additional information, according to embodiments of the present inventions. Such additional non-video displays may include, for example, color OLED displays. Non-video displays 120 and 122 may display advertizing by means of vertically scrolling promotional text (displayed, for example, at less than 15 data refresh per second) and graphic icons. Non-video display 124 may display information regarding the status of the bill/ticket acceptor or some color graphics. Similarly, non-video display 126 may display information regarding the status of the ticket printer. Likewise, non-video display 128 may display information regarding the status of BET button 108 or some color graphics. Also, non-video displays 130 may display information regarding the function of each option button, as text, icon or a combination of both.

Figure 2:
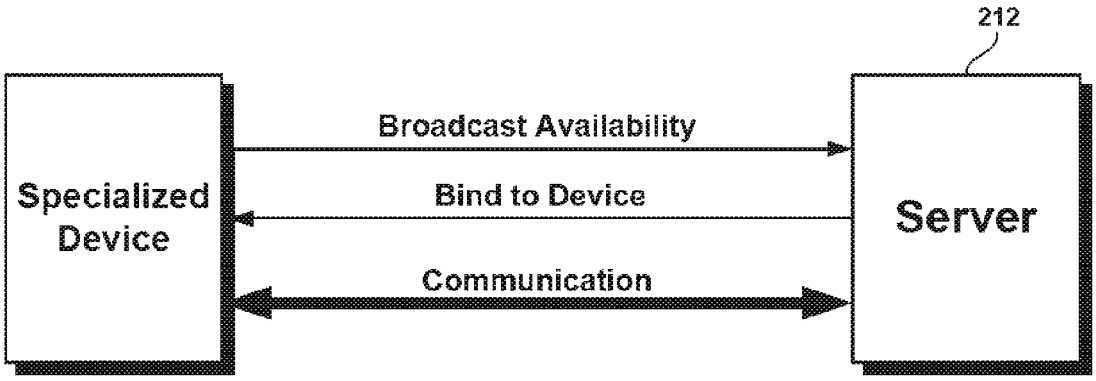
FIG. 2 is a diagram depicting a plug and play protocol, in accordance with an embodiment of the present invention.

Prior to a further description of the present video and non-video display specialized devices according to embodiments of the present inventions, the description to follow further details the manner in which specialized devices such as the aforementioned video and non-video displays may communicate with other nodes on a computer network, to enable the specialized devices to thereby provide and/or consume services. An embodiment of the present invention includes automatic binding of specialized devices with the central server(s) 112 following their activation for example after power-on or reset. FIG. 2 shows a simplified diagram wherein a specialized device coupled to the central servers) 212 over a computer network sends, following its activation, broadcast packets over the network indicating its availability. The broadcast packet may contain data identifying the specialized device (using an Electronic Serial Number or ESN, for example) and describing its location and capabilities. The server 212 that needs to communicate with this specialized device then enters into a binding protocol in order to establish bi-directional communication. According to an embodiment of the present inventions, such a binding protocol for automatic binding is the Universal Plug and Play standard proposal led by Microsoft, although other binding protocols may be used.

Figure 3:
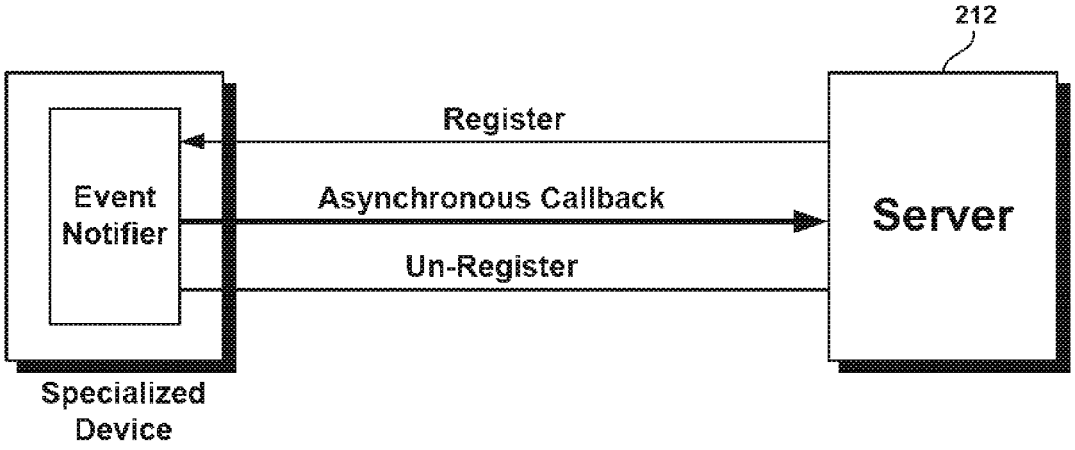
FIG. 3 is a diagram depicting asynchronous notification of events, in accordance with an embodiment of the present invention.

According to another embodiment of the present invention, the specialized devices may be configured to offer asynchronous notification of events directly to the central server(s) 212 over a communication network. FIG. 3 shows a simplified diagram wherein a specialized device, coupled to the central server(s) 212 by a network, sends asynchronous notifications packets to the central server(s) 212 following an event being received by the specialized device or an event generated by the specialized device. For asynchronous notification of events, the servers) 212 may register (subscribe) with the specialized devices for the list of events that are of interest. Then, the event notification process miming in the specialized device may produce a call back to the server(s) 212 (thus the name callback) in order to pass details on the event information when it occurs. A mechanism to un-register (unsubscribe) may be provided wherein the server(s) may inform the specialized device to stop sending asynchronous notification of events. A preferred embodiment of the asynchronous notification of events is the callback feature of COM+, DCOM, REMOTING technologies from Microsoft and the callback capability of SOAP, although other technologies may be implement within the context of embodiments of the present invention.

SOAP is the successor of XML-RPC. SOAP originally stood for Simple Object Access Protocol, and lately also Service Oriented Architecture Protocol, but is now simply SOAP. The SOAP specification is currently maintained by the XML Protocol Working Group of the World Wide Web Consortium. SOAP is encapsulated in the Microsoft WCF—Windows Communication Foundation available in ".NET Framework 3.0" and later versions. According to embodiments of the present inventions, abstract layers may be built on SOAP for providing a service oriented architecture (SOA) such as a publish-and-subscribe message bus. A bus, according to embodiments of the present inventions, may then be thought of as a service messaging engine based on, for example, standards such as SOAP, RPC, Microsoft Remoting, CORBA, RSS and/or Microsoft WCF (Windows Communication Foundation of .NET Framework 3.0).

FIGS. 4, 5, 6, 7 and 8 illustrate views of a service based gaining system in which SOAP is used, according to embodiments of the present inventions. In the figures, a node may be or include a computer, personal digital assistant, cell phone, router, switch, hub, server, workstation, handheld PC, gaining machine, specialized device, an ATM or other device or process having the requisite processing functionality.

Figure 4:
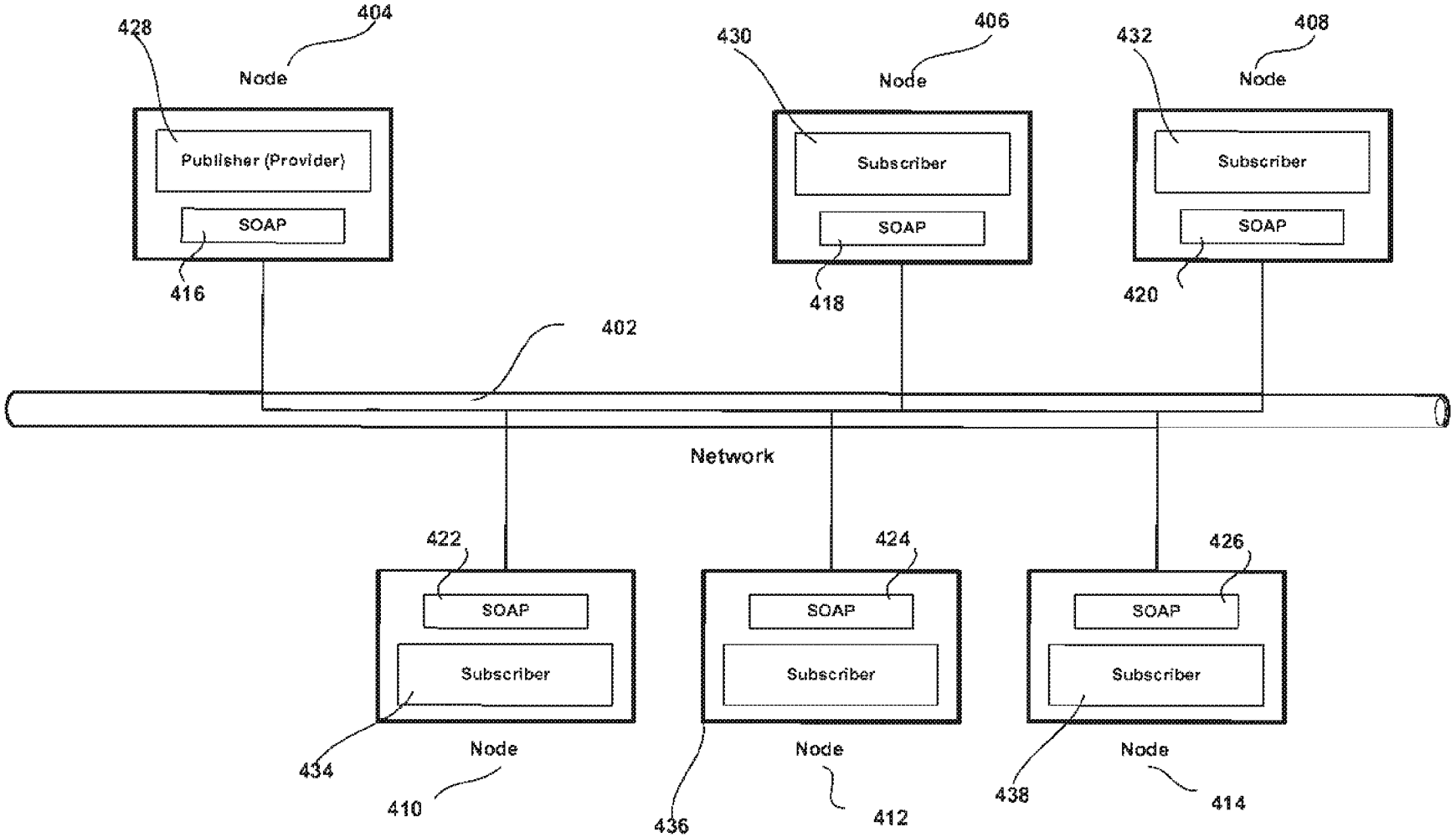
FIG. 4 illustrates a service based gaming system according to an embodiment of the present invention, including a plurality of nodes arranged such as to offer one service publisher and multiple service subscribers.

FIG. 4 illustrates a view of the service based gaming system according to an embodiment of the present inventions including a plurality of nodes 404, 406, 408, 410, 412 and 414 arranged such as to offer one service publisher 428 and multiple service subscribers 430, 432, 434, 436 and 438. The network 402 is representative of a physical communication medium that may be loosely coupled (e.g. LAN, WAN, Ethernet, Internet, Wi-Fi, Bluetooth, USB-to-LAN adapters or a combination of them), tightly coupled (i.e. interprocess communication within a device or via USB) or a combination of loosely coupled and tightly coupled communication mediums. A SOAP communication stack 416, 418, 420, 422, 424 and 426 may be included in each node to allow the communication of services. The publisher/publisher (the two terms being synonymous) 428 may publish (or provide) services that one or a plurality of subscribers (or consumers) may consume, over the network 402. The services provided by the publishing node 404/428 may be (a) high level functions such as from a business application server, a bonusing server, a customer loyalty server, a progressive jackpot server and a player tracking server, or (b) services from a specialized device, e.g. a network connected printer, a network connected bill acceptor, a player tracking combo (video display+touchscreen+card reader) and devices connected to a network bridge USB to Ethernet or RS232 to Ethernet. The services provided by the publishing node 404/428 may be consumed independently by multiple subscribing nodes 406/430, 408/432, 410/434, 412/436 and/or 414/438.

Figure 5:
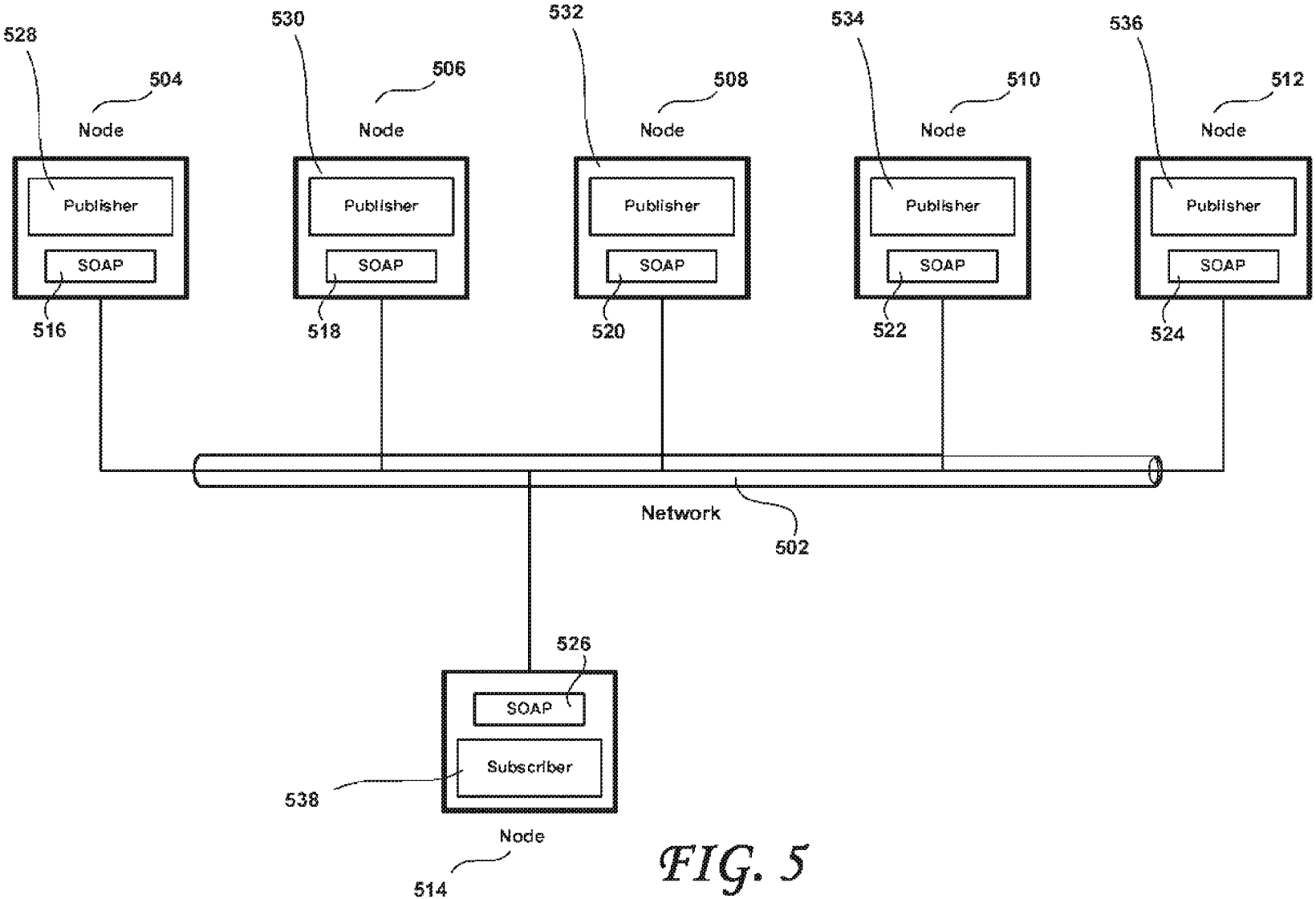
FIG. 5 illustrates a service based gaming system according to an embodiment of the present invention, including a plurality of nodes arranged such as to offer multiple service publishers and one service subscriber.

FIG. 5 illustrates a view of a service based gaming system, according to an embodiment of the present inventions. As shown, the service based gaming system may include a plurality of nodes 504, 506, 508, 510, 512 and 514 arranged such as to offer multiple service publishers 528, 530, 532, 534 and 536 and one service subscriber 538. The network 502 is representative of a physical communication medium that may be a loosely coupled (e.g. LAN, WAN, Ethernet, Internet, Wi-Fi, Bluetooth, USB-to-LAN adapters or a combination of them), tightly coupled (i.e. interprocess communication within a device or via USB) or a combination of loosely coupled and tightly coupled communication mediums. A SOAP communication stack 516, 518, 520, 522, 524 and 526 may be included in each node to allow the communication of services. The services provided by the publishing node 504/528, 506/530, 508/532, 510/534 and/or 512/536 may be (a) high level functions such as from a business application server, a bonusing server, a customer loyalty server, a progressive jackpot server and a player tracking server, or (b) services from a specialized device, e.g. a network connected printer, a network connected bill acceptor, a player tracking combo (video display+touch-screen+card reader) and devices connected to a network bridge USB to Ethernet or RS232 to Ethernet. The services provided by the publishing nodes 504/528, 506/530, 508/532, 510/534 and 512/536 may be consumed independently by one subscribing node 514/538; for example, network connected printers installed in gaming machines may publish a range of services and a maintenance server may subscribe to, e.g., a paper jam alert and the paper low alert services such that the maintenance server may forward a job order to a technician on his or her mobile device.

Figure 6:
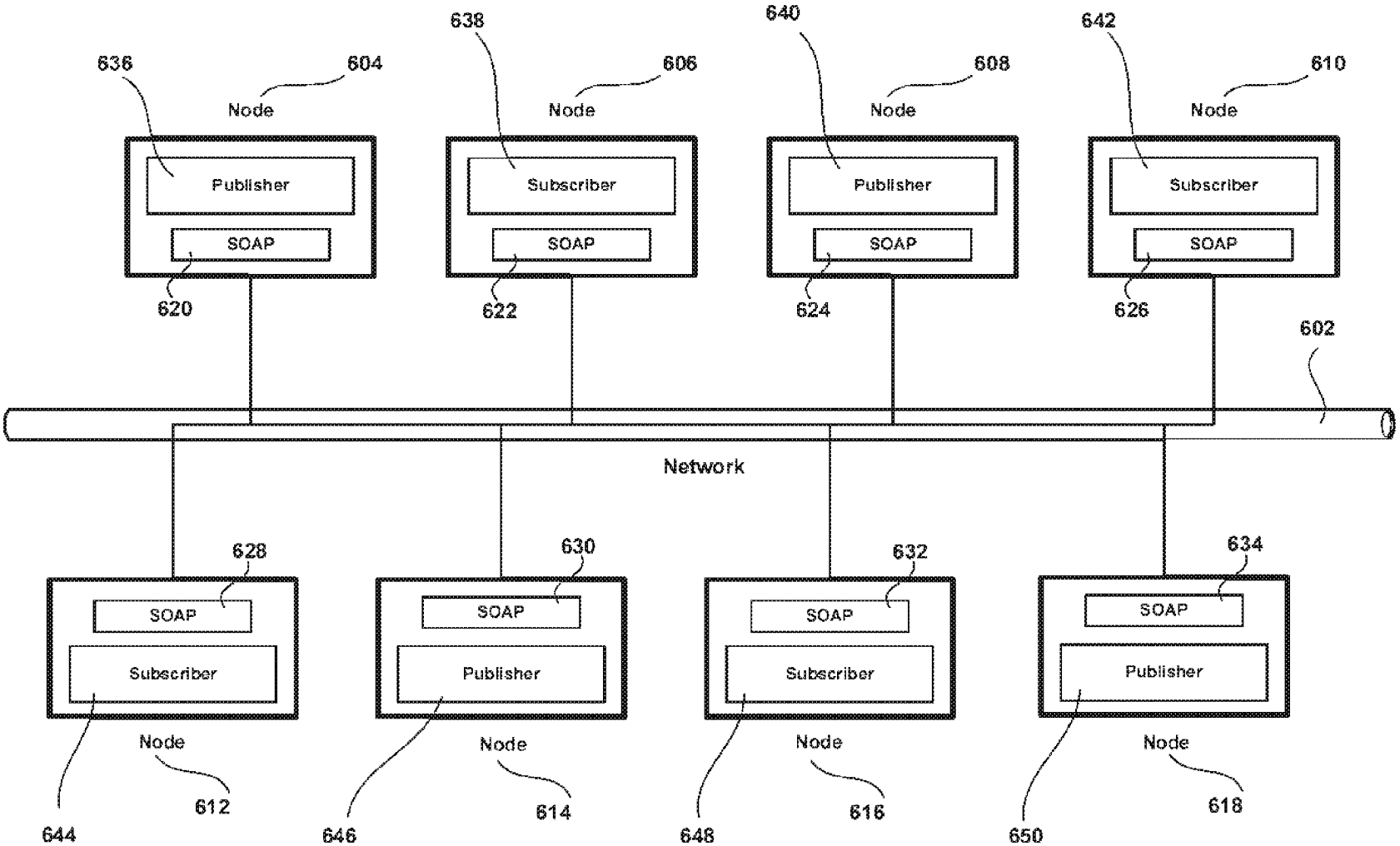
FIG. 6 illustrates a view of the service based gaming system according to an embodiment of the present invention, including a plurality of nodes arranged such as to offer multiple service publishers and multiple service subscribers.

FIG. 6 illustrates a view of a service based gaming system according to another embodiment of the present invention that may include a plurality of nodes 604, 606, 608, 610, 612, 614, 616 and 618 arranged such as to offer multiple service publishers 636, 640, 646 and 650 and multiple service subscribers 638, 642, 644 and 648. As described relative to FIGS. 21 and 22, the network 602 may be representative of a physical communication medium that may be a loosely coupled (e.g. LAN, WAN, Ethernet, Internet, Wi-Fi, Bluetooth, USB-to-LAN adapters or a combination of them), tightly coupled (i.e. interprocess communication within a device or via USB) or a combination of loosely coupled and tightly coupled communication mediums. A SOAP communication stack 620, 622, 624, 626, 628, 630, 632 and 634 may be included in each node to allow the communication of services.

Figure 7:
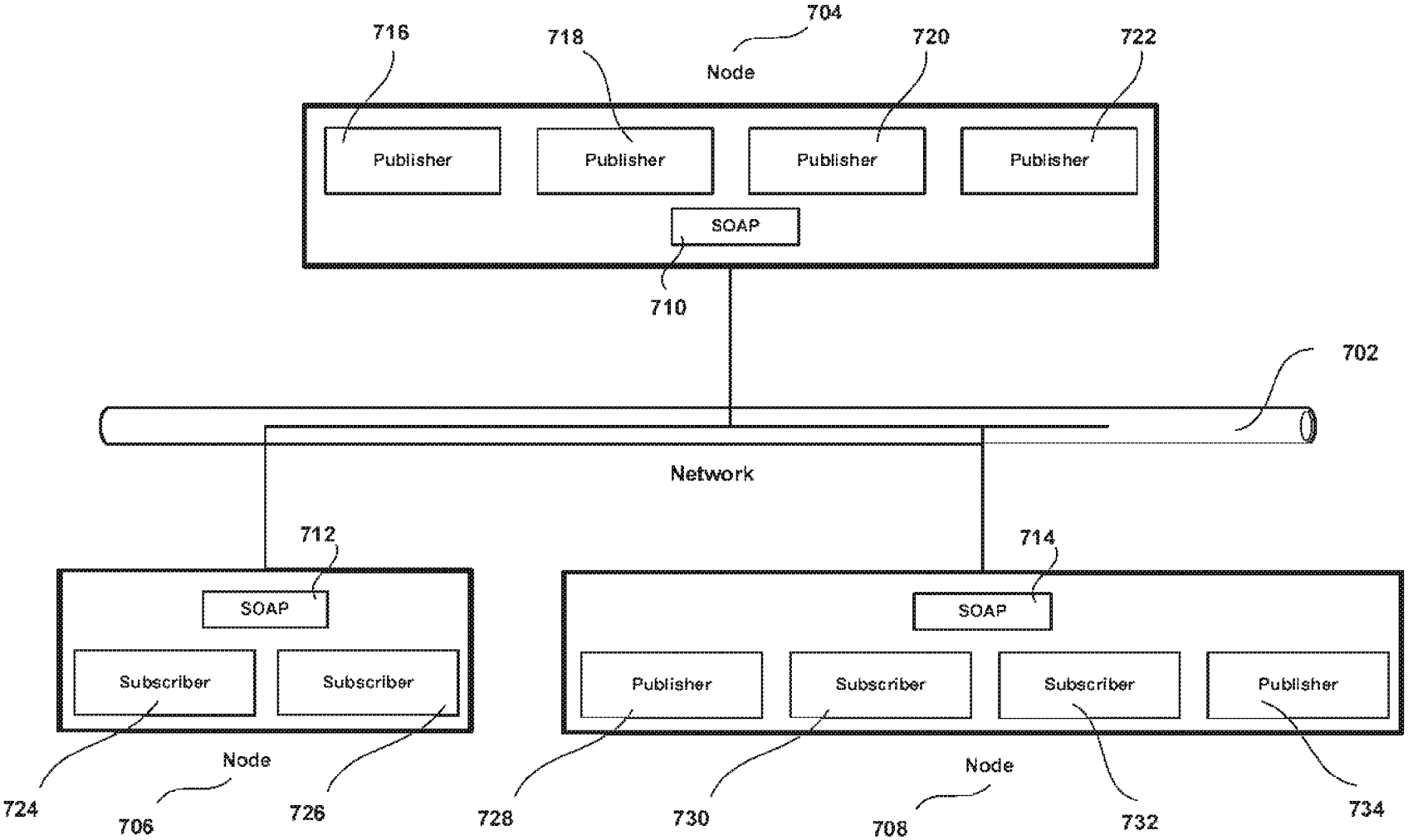
FIG. 7 illustrates a view of the service based gaming system according to an embodiment of the present invention, including a plurality of nodes, wherein each node is arranged such as to offer a one service publisher, multiple service publishers, one service subscriber and/or multiple service subscribers.

FIG. 7 illustrates a view of a service based gaming system according to an embodiment of the present invention. As shown, the service based gaming system of FIG. 7 may include a plurality of nodes 704, 706 and 708, wherein each node is arranged such as to offer one or more of: one service publisher, multiple service publisher's, one service subscriber and multiple service subscribers. The network 702 is representative of a physical communication medium that may be a loosely coupled (e.g. LAN, WAN, Ethernet, Internet, Wi-Fi, Bluetooth, USB-to-LAN adapters or a combination of them), tightly coupled (i.e. interprocess communication within a device or via USB) or a combination of loosely coupled and tightly coupled communication mediums. A SOAP communication stack 710, 712 and 714 may be included in each node to allow the communication of services. For example, node 704 may include a central media server that may be configured to publish (provide), for example, music content 716, advertising video content 718, promotional video content 720 and a live TV feed 722 to authorized participating nodes in the distributed gaming system. Node 706 may include, for example, a billboard in a bar section wherein one network connected streaming plasma display 724 may subscribe to the live video TV feed 722 and the network connected ambience audio system may subscribe to the music content 716. Node 708 may include, for example, a gaming machine wherein an instance of a media player process 730 may subscribe to the live video TV feed 722 and another instance of a media player process 732 may subscribe to the advertising video content 718, and the video contents may be displayed simultaneously on the video gaining display or displays through a separate video window or 3D viewport. The gaming machine (node) 708 may publish 728 its gaining meters using the GSA G2S protocol (Game Standard Association Game-to-System protocol), and any authorized node may subscribe to receive the gaming meters such as a casino management system (whose primary function is to satisfy regulatory accounting), a game download server, a security server, a marketing server, a player tacking server and/or a maintenance server, for example.

Figure 8:
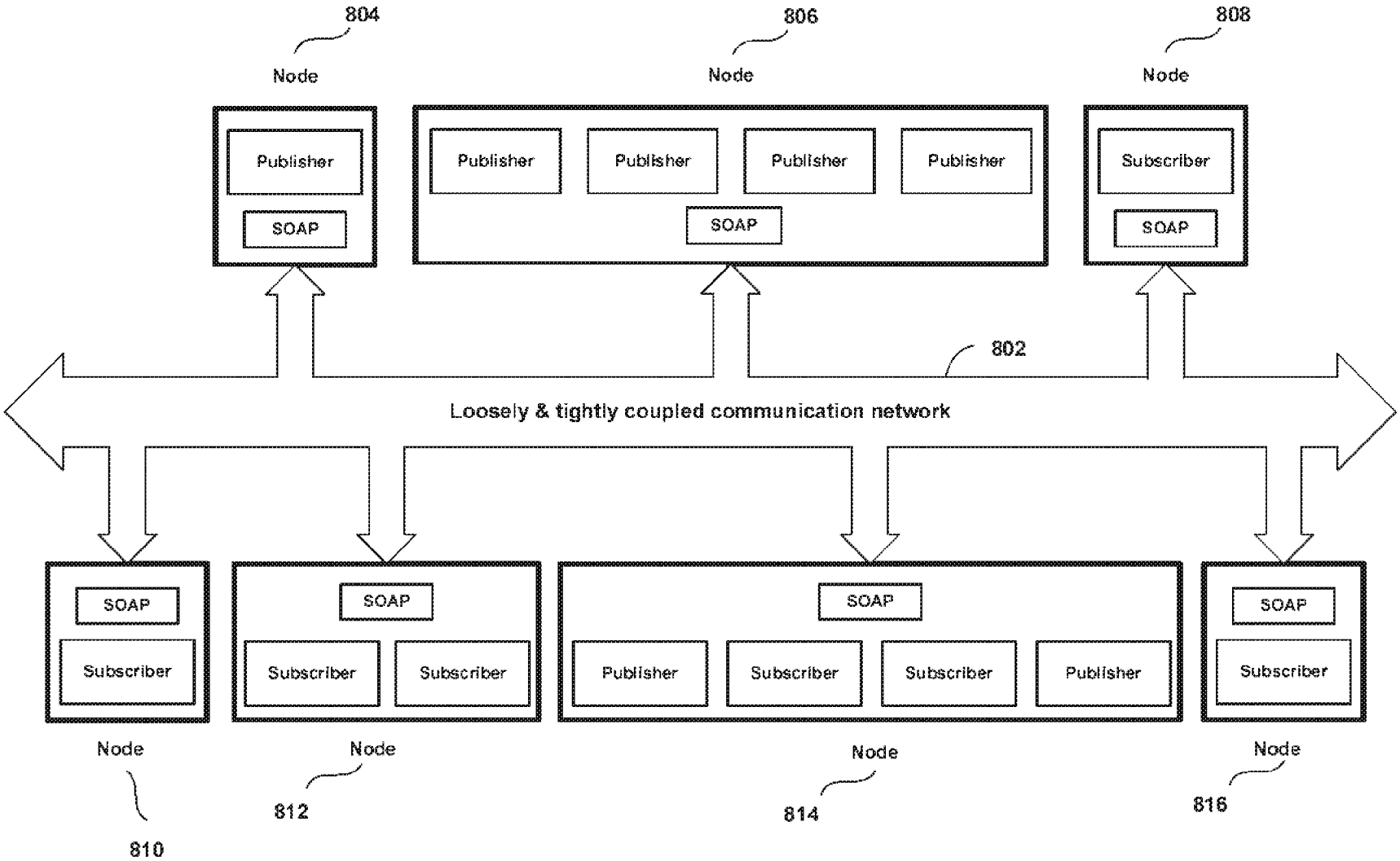
FIG. 8 illustrates a view of the service based gaming system according to an embodiment of the present invention, including a plurality of nodes, wherein each node is arranged such as to offer one service publisher, multiple service publishers, one service subscriber and/or multiple service subscribers and wherein the communication network is pictured as a service bus that may include loosely coupled and/or tightly coupled nodes.

FIG. 8 illustrates a view of the service based gaming system according to an embodiment of the present invention. As shown, the present service based gaming system may include a plurality of nodes, and each node may be arranged such as to offer one or more of the following: (a) one service publisher, (b) multiple service publishers, (c) one service subscriber and (d) multiple service subscribers. The communication network labeled "network bus" 802 may include loosely coupled and tightly coupled nodes carrying network services via the SOAP stack. Node 804 may include, for example, a USB printer specialized device located within an ATM for publishing printing services in the ATM. Node 808 may include, for example, a technician Wi-Fi handheld mobile device subscribing to alerts to repair jammed printers or bill acceptors. Node 810 may include, for example, a billboard subscribing to a Keno server (not shown) that displays the published results of that Keno server.

In the illustrations of FIGS. 4, 5, 6, 7 and 8, the service discovery is not shown but may include any service discovery protocol as discussed previously, such as UDDI and SSDP. UDDI (Universal Description, Discovery and Integration) is a platform-independent, XML-based registry for businesses worldwide to list themselves on the Internet. UDDI is an open industry initiative, enabling businesses to publish service listings and discover each, other and define how the services or software applications interact over the Internet. UDDI may also be applied in an Intranet network. SSDP (Simple Service Discovery Protocol) is the basis of the discovery protocol of Universal plug-and-play. SSDP provides a mechanism through which network clients can use to discover network services. Clients can use SSDP with little or no static configuration. SSDP provides multicast discovery support, server-based notification, and discovery routing. SSDP uses XML UDP unicast and multicast packets to advertise their services.

Nodes may be added and removed to the network; new services will be discovered and bound automatically, and services that are no longer available will be detected and their associated binding will be terminated. Nodes may be provided by any supplier complying with the service bus protocol. In the figures, the SOAP stack is the network service, but as may be readily inferred by persons of skill in the distributed network architecture arts, any other network service stack offering similar capability may be used, including the associated service discovery scheme.

Figure 9A:
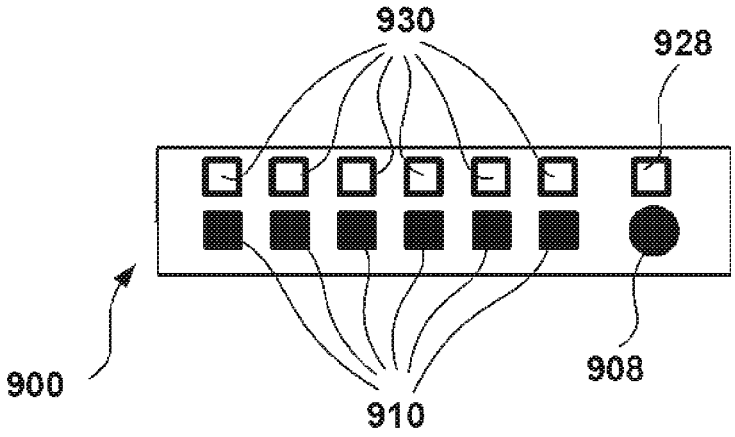
FIG. 9*a* illustrates a front panel of a gaming machine according to embodiments of the present invention, including a BET button and an associated BET button non-video display for its status, and a number of option buttons, each with an associated option button non-video display to indicate their respective function and/or status.

Returning now to video and non-video displays according to embodiments of the present invention, FIG. 9*a* illustrates the front panel 900 of a gaming machine according to embodiments of the present inventions. The front panel 900 may include a BET button 908 and an associated BET button non-video display 928 (e.g., a color OLED) for its status, six option buttons 910, each with an associated option button non-video display 930 (e.g., a color OLED) to indicate their respective function and/or status. Controllers for these buttons and non-video displays, according to embodiments of the present invention, are represented in FIG. 9*b* to 9*e*.

Figure 9B:
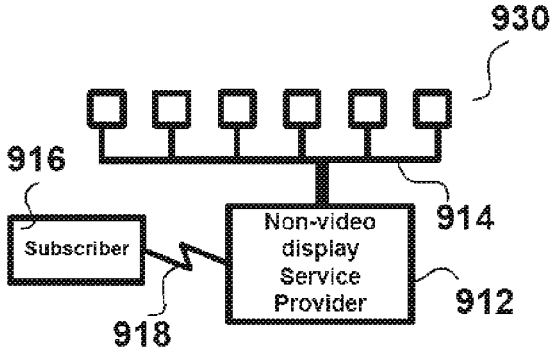
FIG. 9*b* illustrates a specialized device comprising the 6 non-video displays indicating the function and/or status of the option buttons, according to an embodiment of the present inventions.

FIG. 9*b* illustrates a specialized device comprising the six non-video displays 930 indicating the function and/or status of the option buttons 910, according to an embodiment of the present inventions. The six non-video displays 930 may be controlled by a non-video display service provider 912 (via an electrical/electronic interface 914) comprising the necessary computer, electronics and software to provide and consume non-video display services to and from a subscriber 916 via a tightly coupled or a loosely coupled communication connection 918, as described above.

Figure 9C:
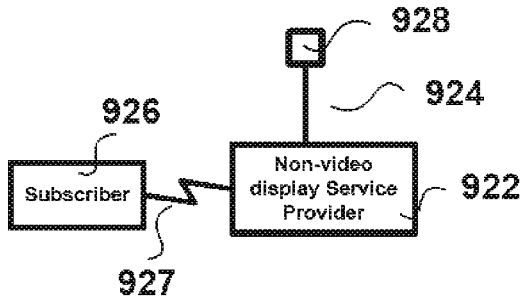
FIG. 9*c* illustrates a specialized device that includes a non-video display that indicates the status and/or function of a BET button, according to an embodiment of the present inventions.

FIG. 9*c* illustrates a specialized device comprising the non-video display 928 that indicates the status and/or function of the BET button 908, according to an embodiment of the present inventions. The non-video displays 928 may be controlled (via the electrical/electronic interface 924) by a non-video display service provider 922 that includes the necessary computer, electronics and software to provide and consume non-video display services to and from a subscriber 926 via a tightly coupled or a loosely coupled communication connection 927.

Figure 9D:
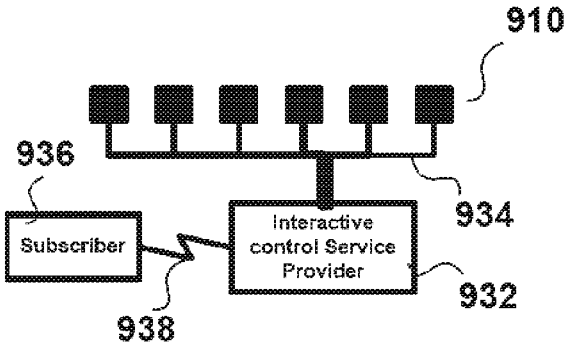
FIG. 9*d* illustrates a specialized device that includes option buttons, according to an embodiment of the present inventions.

FIG. 9*d* illustrates a specialized device comprising the six option buttons 910, according to an embodiment of the present inventions. The six option buttons 910 may be controlled by an interactive control service provider 932 (via the electrical/electronic interface 934) that includes the necessary computer, electronics and software to provide and consume interactive control services to and from a subscriber 936 via a tightly coupled or a loosely coupled communication connection 938.

Figure 9E:
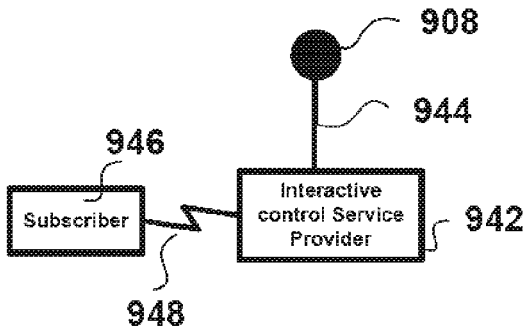
FIG. 9*e* illustrates a specialized device that includes a BET button, according to an embodiment of the present inventions.

FIG. 9*e* illustrates a specialized device comprising the BET button 908, according to an embodiment of the present inventions. The BET button 908 may be controlled (via the electrical/electronic interface 944) by an interactive control service provider 942 that includes the necessary computer, electronics and software to provide and consume interactive control services to and from a subscriber 946 via a tightly coupled or a loosely coupled communication connection 948.

The non-video display 928 indicating the status and/or the function of the BET button 908 may be located substantially close to the BET button 908 such that it is visible when the player holds his finger or hand on or above the BET button 908. The specialized device of FIG. 9*c* and the specialized device of FIG. 9*e* are, according to one embodiment of the present inventions, independent. Any synchronization between the activation of the BET button 908 and the operation of the BET button non-video display 928 may only be done by having subscriber 926 and subscriber 946 communicate with one another via a tightly or a loosely coupled communication connection (not shown). Such synchronization may be performed by a high level module within the gaming machine or within any computing computer node on the loosely coupled or tightly coupled gaming network.

The six non-video displays 930 indicating the status and/or- option for the six option buttons 910 may be located substantially close to the respective option buttons 910 such that each is visible when the player holds his finger or hand on or above the associated option button. According to one embodiment of the present inventions, the specialized device of FIG. 9*b* and the specialized device of FIG. 9*d* are independent. Any synchronization between the activation of any of the option buttons 910 and the operation of the associated non-video display 930 may only be done, according to one embodiment of the present inventions, by having subscriber 916 and subscriber 936 communicate with one another via a tightly or loosely coupled communication connection (not shown). The synchronization may be performed by a high level module within the gaming machine or within any computer node on the loosely coupled or tightly coupled gaming network.

Figure 10A:
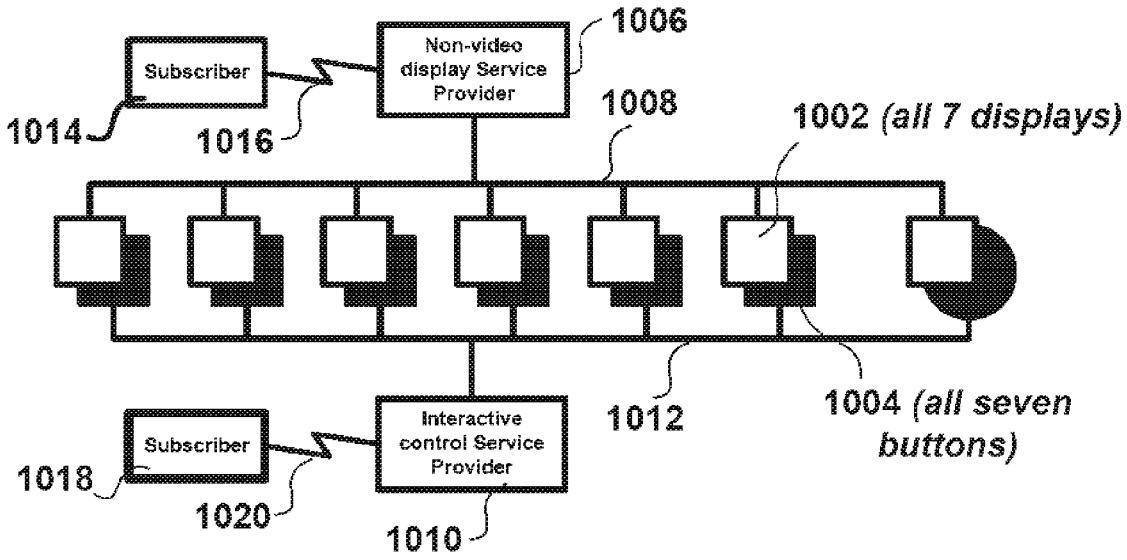
FIG. 10*a* illustrates an embodiment of the present inventions in which the front panel of a regulated gaming machine includes an interactive control specialized device and a non-video display specialized device.

FIG. 10*a* illustrates an embodiment of the present inventions in which the front panel of a regulated gaming machine includes an interactive control specialized device and a non-video display specialized device. The interactive control specialized device may include, as shown at reference numeral 1004, the six option buttons and the BET button mat are controlled by an interactive control service provider 1010 (via the electrical/electronic interface 1012) comprising the necessary computer, electronic and software to provide and consume interactive control services to and from a service subscriber 1018 via a tightly coupled or a loosely coupled communication connection 1020. The non-video display specialized device may include the seven non-video displays 1002 mat are associated with the six option buttons and the BET button. The non-video display specialized device may be controlled by non-video display service provider 1006 (via the electrical/electronic interface 1008) that includes the necessary computer, electronics and software to provide and consume non-video display services to and from a service subscriber 1014 via a tightly coupled or a loosely coupled communication connection 1016.

The interactive control specialized device 1004 and the non-video display specialized device 1002 of FIG. 10*a* are, according to one embodiment of the present inventions, independent. Any synchronization between the activation of any of the buttons of the interactive control specialized device 1004 and the operation of the associated non-video display interactive device 1002 may only be done by having subscriber 1014 and subscriber 1018 communicating together via a tightly or loosely coupled communication connection (not shown). The synchronization may be performed by a high level module within the gaming machine or within any computer node on the loosely coupled or tightly coupled gaming network.

Figure 10B:
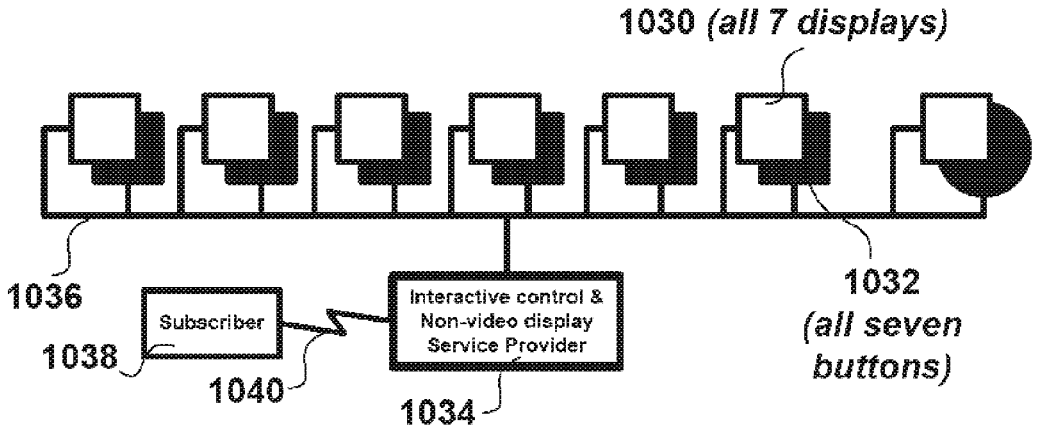
FIG. 10*b* illustrates an embodiment of the present inventions in which the front panel of a regulated gaming machine includes a specialized device controlling the interactive controls and the associated non-video displays.

According to an embodiment of the present inventions, the specialized device 1002 that includes the non-video displays may be (e.g., electrically and/or mechanically) combined with the interactive control specialized device 1004 that includes the option and BET buttons. FIG. 10*b* illustrates an embodiment of the present inventions in which the interactive control and the non-video specialized devices of FIG. 10*a* are aggregated or combined into a single front panel specialized device. The front panel specialized device may include the seven non-video display buttons 1032 (six option buttons and the BET button) and the associated seven non-video displays 1030. Both the buttons and the non-video displays 1032, 1030 may be coupled to and controlled by a single service provider 1034 (via a electrical/electronic interface 1036), the interactive control and non-video display service provider 1034 including the necessary computer and electronic means to provide and consume interactive control and non-video display services to and from a subscriber 1038 via a tightly coupled or a loosely coupled communication connection 1040.

In the embodiment of FIG. 10*b*, the non-video displays 1030 and the respective buttons 1032 coupled to one another, such that the player presses or touches the non-video displays to actuate the underlying buttons, or vice-versa.

FIG. 11 illustrates embodiments of the present inventions for coupling a non-video display and a button. It is to be noted that buttons integrating OLED display technology together with the necessary control circuits to control both the button function and the OLED display already exist. According to an embodiment thereof, the present inventions include a non-video display, such as a color dot matrix OLED approximately one inch by one inch (for example), that features a tactile activation function. According to embodiments of the present inventions, the non-video display and the tactile activation function may be mechanically independent of one another. According to an embodiment of the inventions, a plurality of non-video displays and the plurality of associated tactile activation functions are mechanically independent of one another. For example, the non-video display and the tactile activation function may be mechanically independent of one another and each may be controlled by an independent controller. Indeed, according to embodiments of the inventions, a plurality of non-video displays and the plurality of associated tactile activation functions are mechanically independent of one another, and the controller or controllers that controls the plurality of the non-video displays is/are independent from the controller or controllers that controls or control the tactile activation functions.

Figure 11A:
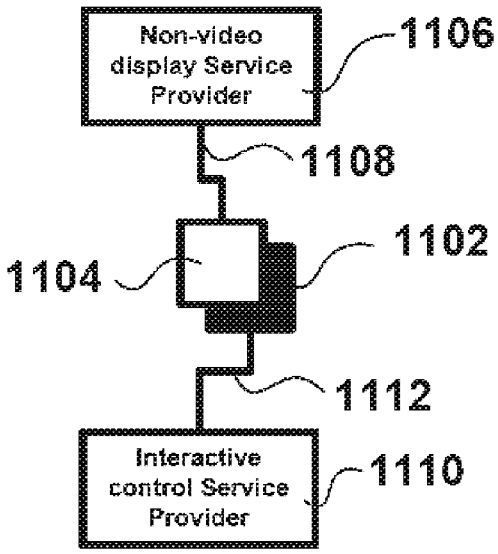
FIG. 11*a* illustrates embodiments of the present inventions for coupling a non-video display and a button.

According to an embodiment of the inventions as illustrated in FIG. 11*a*, a non-video display 1104 may be controlled by a first service provider 1106 (via an electrical/electronic interface 1108) and the assembly (e.g., button) that performs the associated tactile activation function 1102 may be controlled by a second service provider 1110 (via the electrical/electronic interface 1112), the first service provider 1106 and the second service provider 1110 being independent of one another. In this embodiment, the non-video display 1104 is disposed at least partially above the assembly that performs the tactile activation function 1102.

Figure 11B:
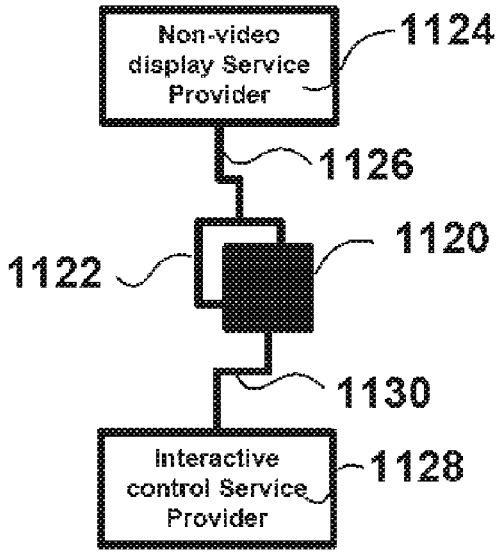
FIG. 11*b* illustrates further embodiments of the present inventions for coupling a non-video display and a button

According to the embodiment of the inventions illustrated in FIG. 11*b*, a non-video display 1122 may be controlled by a first service provider 1124 (via the electrical/electronic interface 1126) and the assembly (e.g., button) that performs the associated tactile activation function 1120 may be controlled by a second service provider 1128 (via the electrical/electronic interface 1130), the first service provider 1124 and the second service provider 1128 being independent. The non-video display 1122 may be disposed at least partially below the associated assembly that performs the tactile activation function 1120. In this embodiment, the associated assembly that performs the tactile activation function 1120 may be at least partially transparent, to enable the at least partially underlying non-video display 1122 to be viewable therethrough.

The plurality of the non-video displays may be controlled by a first service provider and the plurality of the associated tactile activation functions may be controlled by a second service provider, the first service provider and the second service provider being independent of one another.

Having the non-video display (or displays) mechanically independent from the associated tactile activation function (or functions), according to embodiments of the present invention, has a number of advantages. For example, color LCD or color OLED technology that may be included in a non-video display with a tactile activation function, being a new technology, may not have the heavy-duty rating of the buttons of gaming machines and may not be capable of supporting the repeated pounding of the players. The capability to retrofit the hundreds of thousands of legacy gaming machines already in operation with a mechanically and control independent non-video displays is a significant advantage. Such a retrofit would, according to embodiments of the present invention, be carried out such that the control of the non-video displays would be achieved via a service provider under the instructions of a service subscriber and the tactile activation would be achieved by the legacy buttons under the control of the legacy gaming controller.

According to an embodiment of the present inventions, this may be carried out by adding to the legacy front player button panel a non-video display for each button (or selected buttons), which added non-video display is offset as illustrated at FIG. 9*a* such that the non-video display is visible by the player when the player places his finger, fingers or palm over the button to activate it. It is customary for a player to leave his finger, fingers or palm slightly pressed on a button for extended period of time, without causing the button to activate, and then quickly press harder to activate the button function. Being able to see any information change on the non-video display while the player's finger, fingers or palm is/are stationed over the button is a significant advantage.

According to other embodiments, two non-video displays may be provided for each button, one integrated inside the button and one offset as described immediately above, both non-video displays showing the same or different information in accordance with the control service provider that controls them. Each of the non-video display may be controlled by a separate service provider or both non-video displays may be controlled by the same service provider.

Color LCDs and color OLEDs are well known to lose their luminosity very quickly. Therefore, providing the ability to change the color LCDs or color OLEDs without changing or swapping out the assembly that provides the tactile activation is an economical solution.

Moreover, non-video display technology may evolve (higher resolution, faster response, higher brightness, longer life) independently from the tactile activation technology, which, is proven technology that is somewhat more unlikely to evolve greatly. Having separate controls for the assembly providing the activation function and the non-video display ensures limited impact on the game controller software when a new non-video display technology is introduced, or when non-video display parts are no-longer produced.

Moreover, the independence of the non-video displays and the assemblies for providing the activation functions means that failure of one or more non-video display(s) does not result in the failure of the associated button function.

Figure 12:
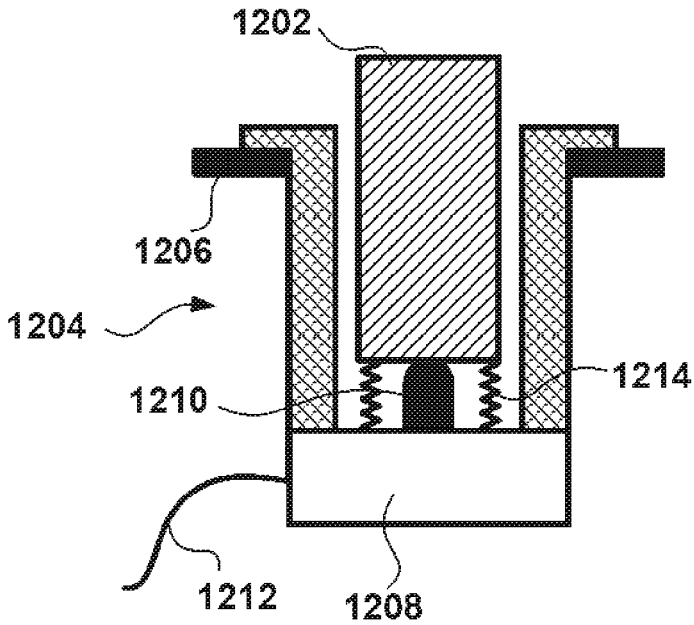
FIG. 12 (Prior Art)
FIG. 12 shows a cross-sectional view of a conventional push-button.
Figure 12:
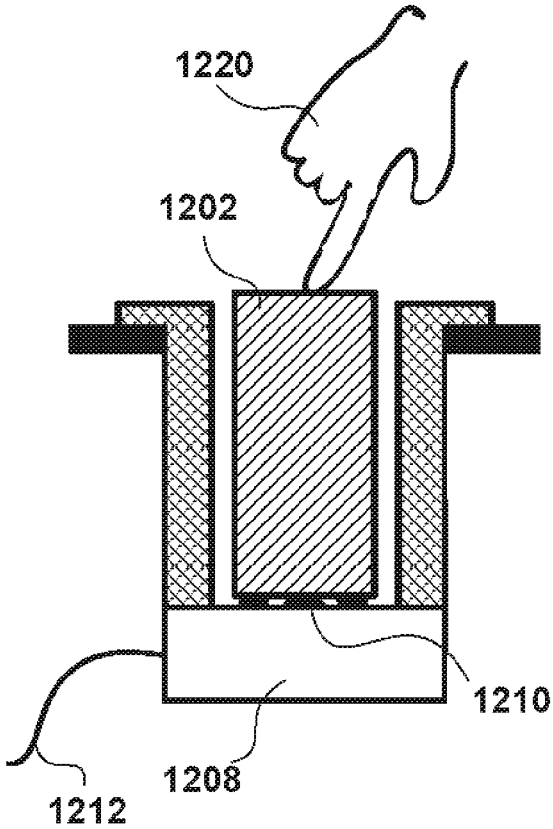
FIG. 12 (Prior Art)

FIG. 12 shows a cross-sectional view of a conventional push-button. As shown, a button plunger 1202 slides up and down within a button housing 1204. The button housing 1204 is affixed to a front panel 1206. An electric switch 1208 is affixed attached to the button housing 1204 of the gaming machine and includes an activation sensor 1210 and a connection 1212 to transmit a detection signal to a control circuit (not shown). One or more springs 1214 bias the button plunger 1202 in a standby position. The precise maimer in which the button housing 1204 is affixed to the front panel 1206 (such as by an adhesive or fasteners, for example), the manner in which the button plunger 1202 may be mechanically retained within the housing and the manner in which the button plunger 1202 provides tactile feedback are not shown but are well known in the art of push button design.

When a player hand or finger 1220 presses the button 1222, the activation sensor 1210 is activated and the switch 1208 transmits the detection signal over the connection 1212.

Conventional smart switches, programmable legend switches and display key switches are principally push buttons of the kind described above relative to FIG. 12 and include a video display or a non-video display fixed either on the button housing 1204 or on the button plunger 1202. Moreover, the control circuits to control the video display or the non-video display are also conventionally fixed either on the button housing 1204 or on the button plunger 1202.

Figure 13:
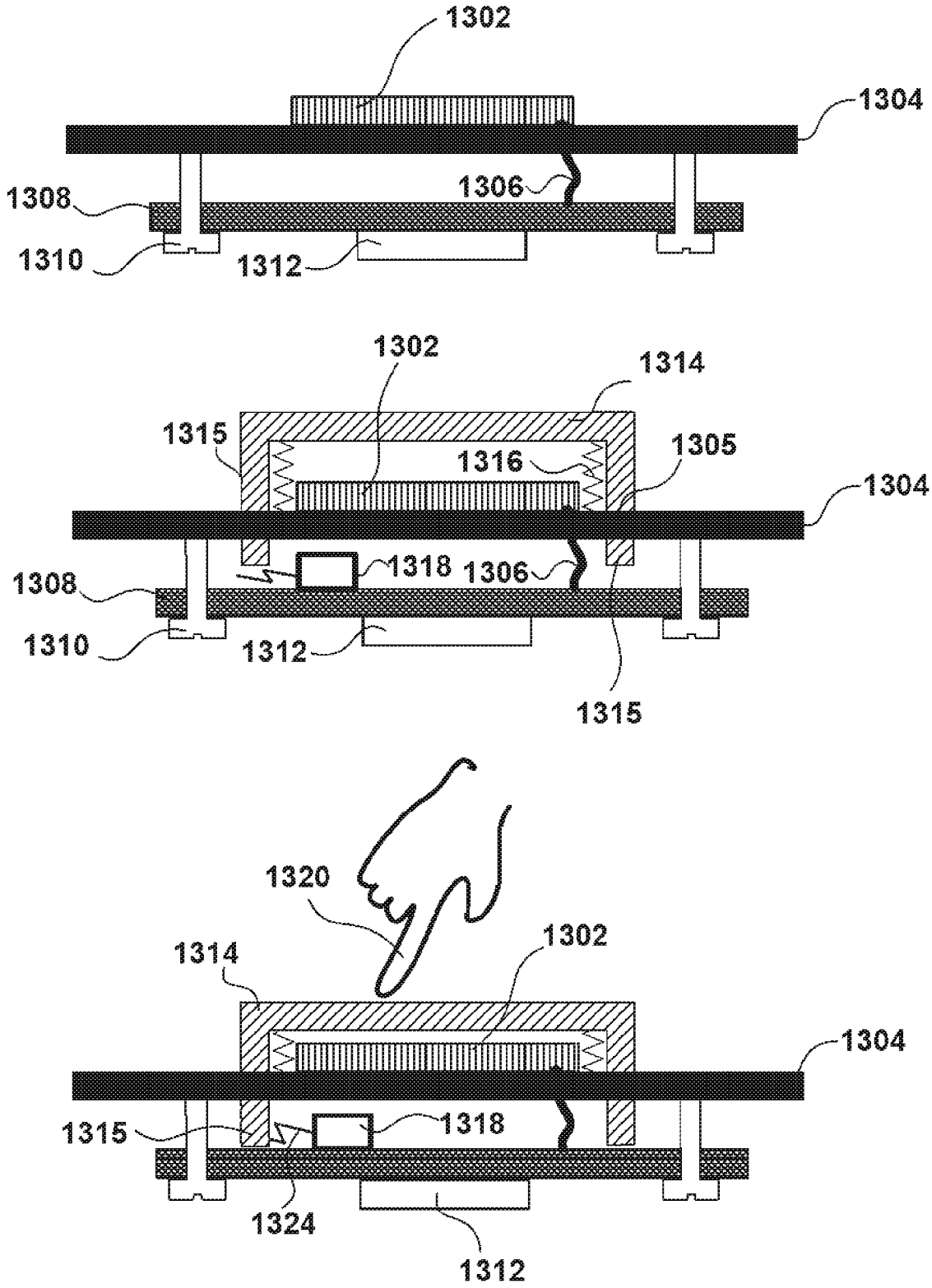
FIG. 13 illustrates an embodiment in which, a least one non-video display (for example, a color OLED array of 96×96 pixels) is attached or otherwise coupled to a front panel plate (e.g. a chromed metal plate) of a gaming machine and is controlled by a controller circuit via an interface (such as a flexible PCB, for example).
Figure 14:
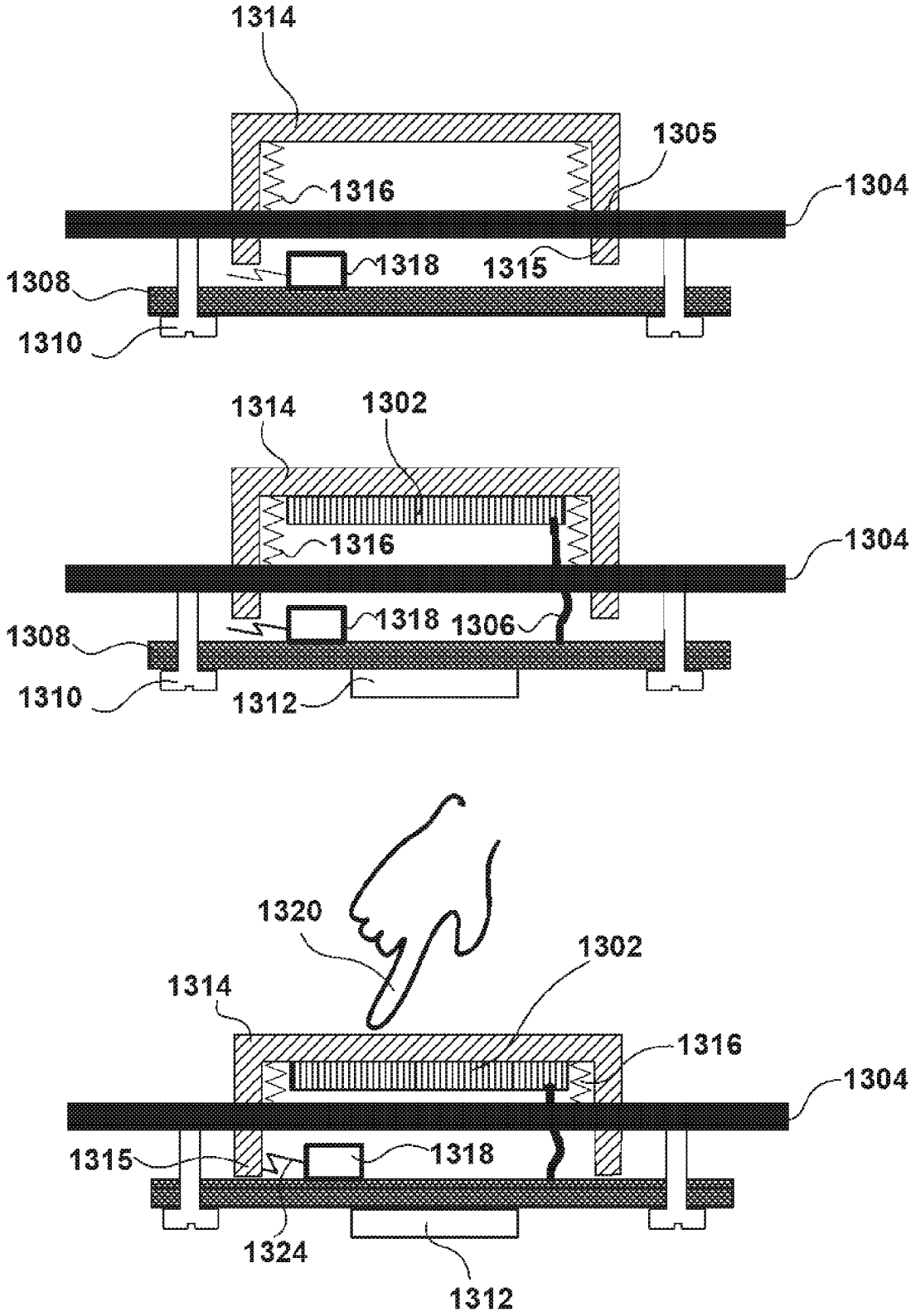
FIG. 14 illustrates another embodiment of a push button having a tactile function attached to a front plate (plastic or metal) of a gaming machine to enable a player to place bets and select options.

FIG. 13-14 illustrates an embodiment of the present inventions in which a video display or a non-video display is not attached either to a button housing 1204 or to the button plunger 1202. Moreover, according to further aspects of the present embodiments, the control circuits to control the video or non-video display or a non-video display are also not attached either to the button housing 1204 or to the button plunger 1202.

Figure 15:
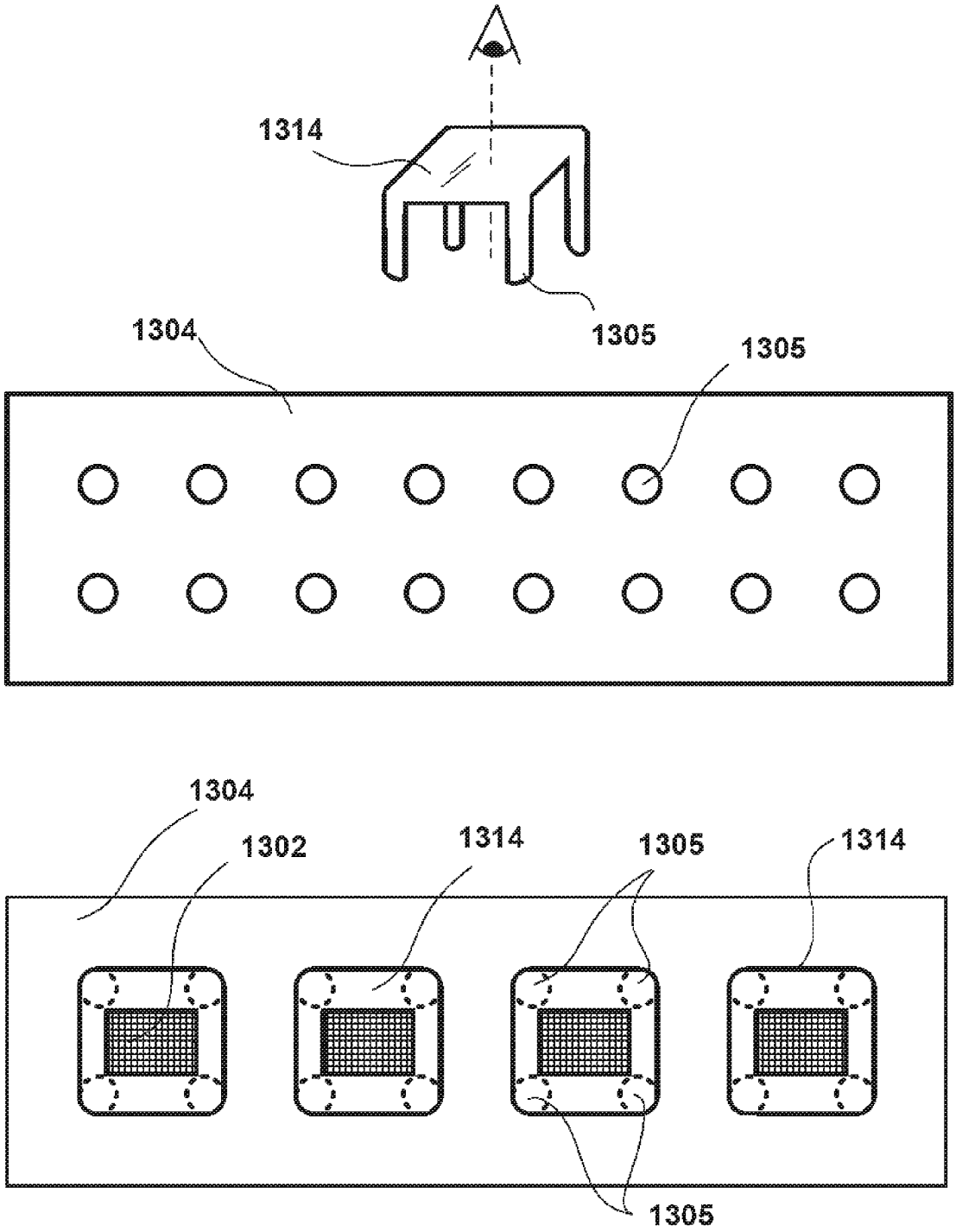
FIG. 15 shows the manner in which a plurality of push buttons may be configured to plunge directly through the front plate of a gaming machine such that the constituent non-video displays may be seen by a player standing in front of the gaming machine or terminal, according to embodiments of the present invention.
Figure 16:
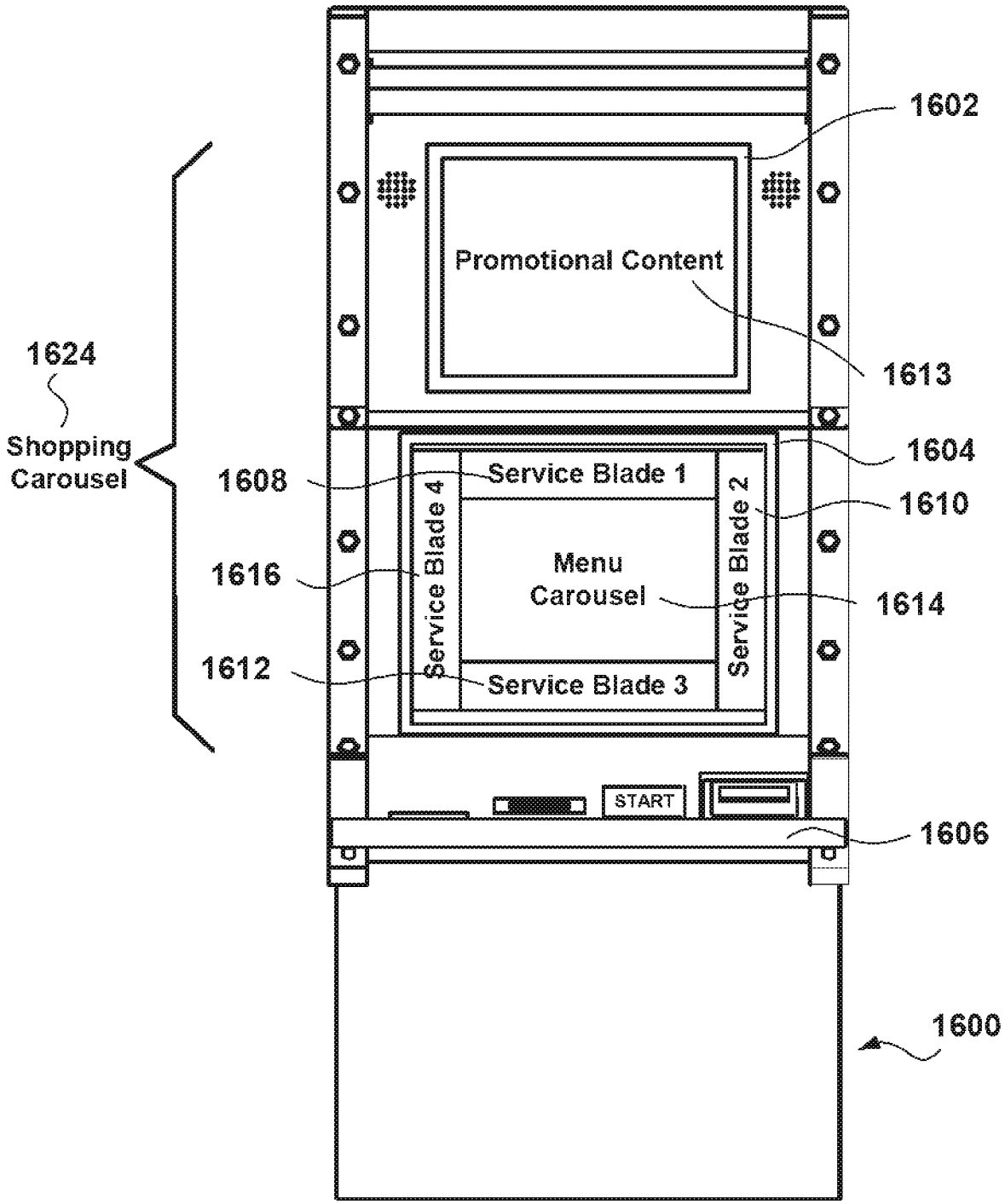

FIG. 15 illustrates another embodiment in which a video display or a non-video display is not attached to a button housing, but is attached to a button plunger. In this embodiment as well, the control circuits to control the video or non-video display are not attached either to the housing or to the button plunger.

FIG. 13 illustrates an embodiment in which a least one non-video display 1302 (for example, a color OLED array of 96×96 pixels) is attached or otherwise coupled to a front panel plate 1304 (e.g. a chromed metal plate) of the gaming machine and is controlled by a controller circuit 1312 via interface 1306 (such as a flexible PCB, for example). The controller circuit 1312 may be mounted on a printed circuit board 1308 that is mechanically attached or otherwise coupled to the front panel plate 1304 by screws 1310 (and/or by any other fastener, snap-in locks, rivets, etc.). The controller circuit 1312 may be a component of the non-video service provider 1006 in FIG. 10*a*.

A push button 1314 (also shown in FIG. 15) including a plurality of legs 1315 (also shown in FIG. 15) is placed at least partially over the non-video display 1302. The legs 1315 are inserted in and through the openings (through bores) 1305 (best shown in FIG. 15) that are defined in the front panel plate 1304 (also shown in FIG. 15). The legs 1315 extend through respective openings 1305 and extend below the front panel plate 1304 such as to form a plunging push button. A spring or springs 1316 maintain the button 1314 in a standby position when no force is exerted thereon. Retaining mechanisms to ensure such mat the button 1314 stays in place under the pressure of the spring or springs 1316 are present, albeit are not shown, as such retaining means are well known in the art. The button 1314 is configured to plunge freely and reliably through the front panel plate 1304 and return to its initial position, as shown in the middle drawing of FIG. 13.

The push button 1314, in the middle drawing of FIG. 13, is shown in its initial, standby position. The push button 1314 may also include a displacement detector 1318. The displacement detector 1318 is configured to detect when the push button 1314 has been depressed by a player. In the middle drawing of FIG. 13, the displacement detector 1318 does not detect that the button 1314 has been pressed by a player. The displacement detector may use photoelectric technology, Hall Effect technology, may be mechanical switch or any other means to detect a displacement known in the art. The displacement detector 1318 may be coupled to the PCB 1308 or any other support that is not a button housing. For example, displacement detector 1318 may be placed attached on the lower side of the front panel plate 1304, on another PCB or on another metal plate. Displacement detector 1318 may be controlled by the controller circuit 1312 that also controls the non-video display 1302. Alternatively, the displacement detector 1318 may be controlled by another controller circuit (not shown) that is independent of the controller circuit 1312 t controls the non-video display 1302.

When player presses 1320 the button 1322 as shown in the bottom figure of FIG. 13, its legs 1315 extend further through the openings 1305 defined within the front panel plate 1304. This extension is then detected, as suggested at 1324, by the displacement detector 1318, which then sends a detection signal to a controller. During the activation and displacement of the button 1314, the non-video display 1302 does not move as the spacing between the non-video display 1302 and the button 1314 is sufficient for the displacement amplitude, which may range from about 0.5 mm to about 1 mm (for example), which displacement is sufficient to offer a good tactile feel for the player. The springs 1316 may be of a design that offer tactile feel commonly used for push buttons, such as known in the art. Any other mechanisms known in the art of key switches and push buttons for offering tactile feel may be implemented within the scope of the present inventions.

FIG. 13, therefore, illustrates an embodiment for adding a tactile function and necessary displacement detection to a non-video display affixed on or to the front panel plate of a regulated (i.e., casino) gaming machine.

FIG. 14 illustrates another embodiment of a push button having a tactile function attached to a front plate (plastic or metal) of a gaming machine to enable a player to place bets and select options. In this embodiment, the non-video display 1302 is attached or otherwise coupled to the underside of the top of the button 1314. The top surface of the push button 1314 is at least partially transparent, so as to enable the information displayed on the non-video display 1302 to be viewable therethrough by a player standing in front of the gaming machine. FIG. 13, therefore, illustrates another embodiment for adding push buttons having non-video displays having a tactile feel to a front panel plate of a regulated gaming machine.

FIG. 15 shows further aspects of embodiments of the present inventions. Specifically, FIG. 15 shows the maimer in which a plurality (four on this exemplary figure, but mere may be any number of such push buttons of any size) of push buttons plunging directly through the front plate of a gaming machine in which the constituent non-video displays may be viewable by a player standing in front of the gaming machine or terminal. As described previously with respect to FIGS. 13 and 14 and as shown in the perspective rendering at the top of FIG. 15, a push button 1314 according to embodiments of the present inventions may include four legs 1315 mat extend from a top portion of the push button 1314. A front plate of the gaming machine may then be machined to define a plurality of openings (i.e., through bores) sized to enable the legs 1315 of each of the push buttons to extend therethrough, as shown in the plan view middle figure of FIG. 15. As shown in the bottom plan view figure of FIG. 33, four push buttons 1314 may then be installed on the front panel plate 1304 of the gaming machine. As shown, the top of the push buttons 1314 are sufficiently transparent so as to enable the underlying non-video displays 1302 to be seen by the player therethrough. The non-video displays may be attached to the front panel plate 1304 as shown in FIG. 13 or to the underside of the push button 1314 as shown in FIG. 14.

The landscape of the casino floors equipped with downloadable gaming machines in which each of the thousands of gaming machines has the capability of offering many (e.g., hundreds) of games to the players will change drastically, due to the manner in which the games will be promoted. With legacy (i.e., non-downloadable) gaming machines, only one game is available on each gaming machine, and choosing a game means that the player may have to walk the entire floor before finding a game he or she wants to play, often based solely upon the promotion of each game on the gaming machine's top display screen, and/or via a distinctive but static decorative theme. It is believed that with gaining machines equipped for downloading games, however, the role of the video displays for game promotion, player selection and interaction with services available via the network is increasingly important. Responsive to this increasing importance, embodiments of the present inventions offer a modular architecture for the video displays of the gaining machine, to enable the gaming machine to offer a rich and varied panoply of promotional, service access, and player selection which are, hereafter, collectively referred to as a "shopping carousel".

The shopping carousel, according to embodiments of the present inventions, enables the game operator to configure the video displays to (a) attract players walking in the vicinity of a machine by displaying a promotional material that catches his or her attention, (b) ensure that the player quickly and easily find what drew him or her to the gaming machine in the first place, and (c) monetize the opportunity thus created by making it near irresistible for the player to buy a contract to play (in the case of a time-based game) or play that game or another game available on that gaming machine.

The shopping carousel may advantageously make use of the player video services provide by the player video displays. Resources located on or otherwise coupled to the network may subscribe and consume player video services provided by the player video displays. In turn, video displays may subscribe to and consume player video services provided by service providers coupled to the network. The player video services may comprise a plurality of services such as for example blade services, video promotion services and menu carousel services.

Figure 16:
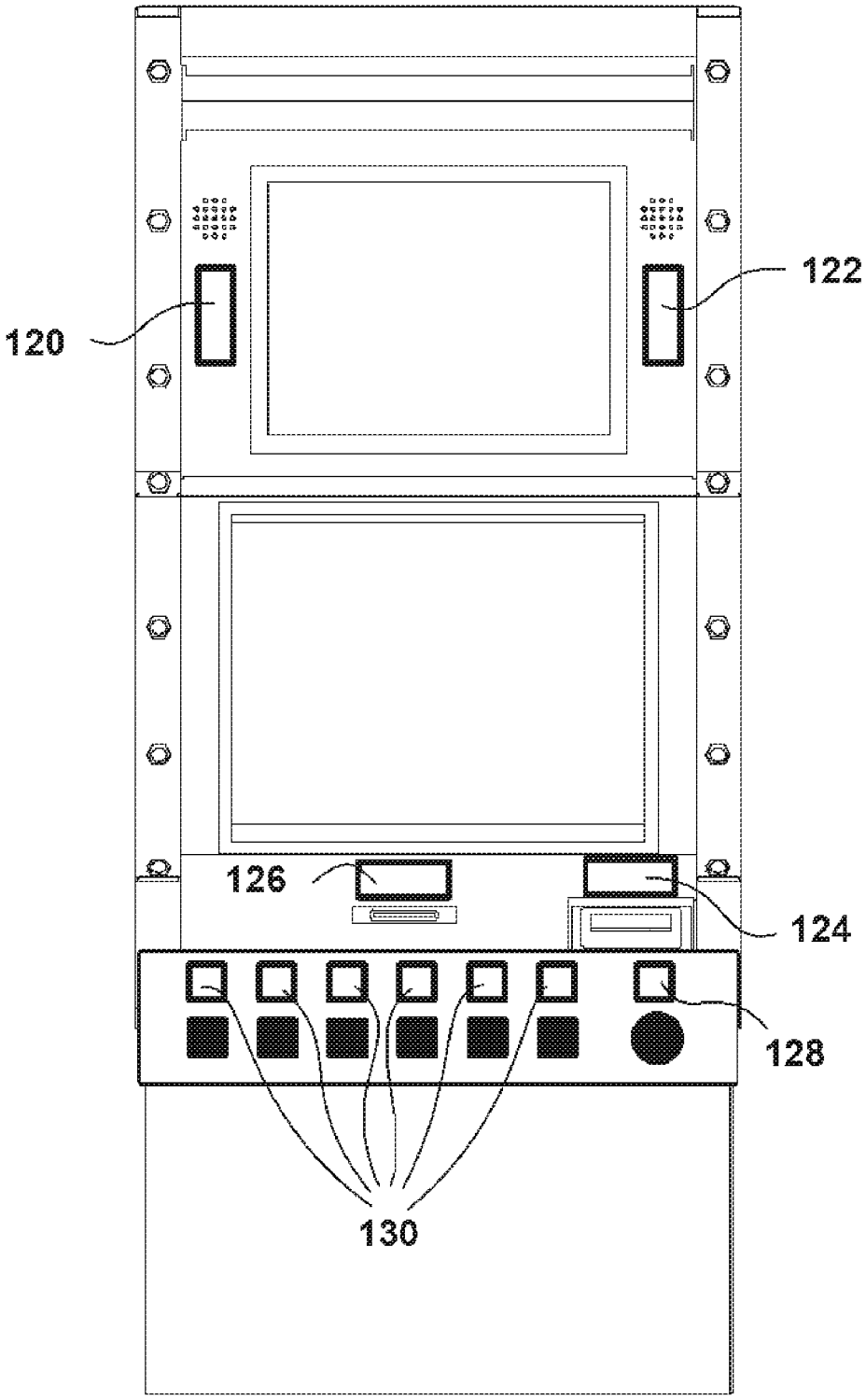
FIG. 16 shows a gaming machine outfitted with a shopping carousel, according to embodiments of the present invention.

FIG. 16 depicts a gaming machine 1600 outfitted with a shopping carousel 1624, according to an embodiment of the present invention. As shown, the shopping carousel 1624 may include carousel services including a menu carousel 1614, four service blades 1608, 1610, 1612 and 1616, and interactive video promotion services 1613 including promotional content. The gaming machine 1600 may include two video displays 1602, 1604, and each may be equipped with a touch-screen to facilitate player interaction. Alternatively, the gaming machine may include a single large format display oriented in portrait (in which the long size is in a vertical orientation). The touch-screen elements of the video displays 1602, 1604 may be a subset of the player interactive controls and provide player interactive services.

The player video displays (e.g., displays 1602, 1604) and the associated player interactive controls (e.g., the touch-screen elements for the video displays 1602 and 1604) may be aggregated such as to provide and to consume a coherent set of shopping carousel services to and from subscribers located on the network (loosely coupled) and/or to and from subscribers located in the gaming machine (tightly coupled), as detailed below.

The player video displays (e.g. 1602 and 1604) and the associated player interactive controls (e.g. the touch-screen elements of video displays 1602 and 1604) may be also be aggregated such as to provide and consume a coherent set of (a) menu carousel services, (b) blade services, and/or interactive video promotional services to and from subscribers located on the network (loosely coupled) and/or to subscribers located in the gaming machine (tightly coupled), as detailed below.

Figure 17A:
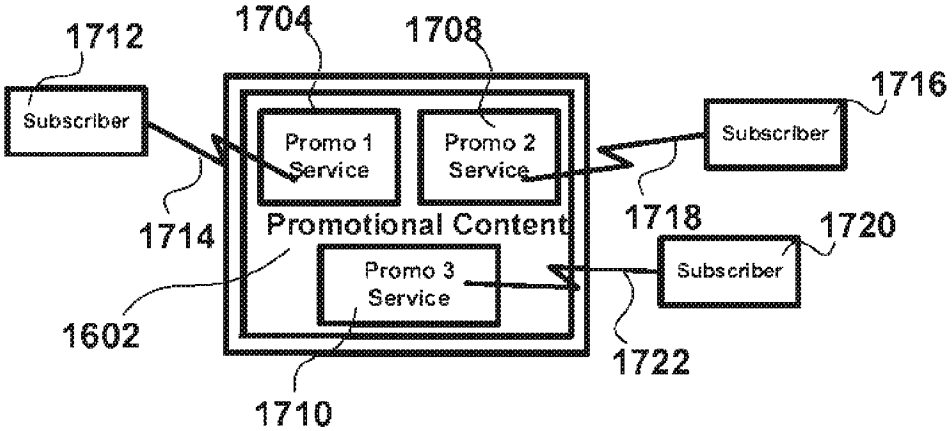
FIG. 17*a* shows exemplary shopping carousel services provided on a top video display of a gaining machine, according to embodiments of the present invention.
Figure 17B:
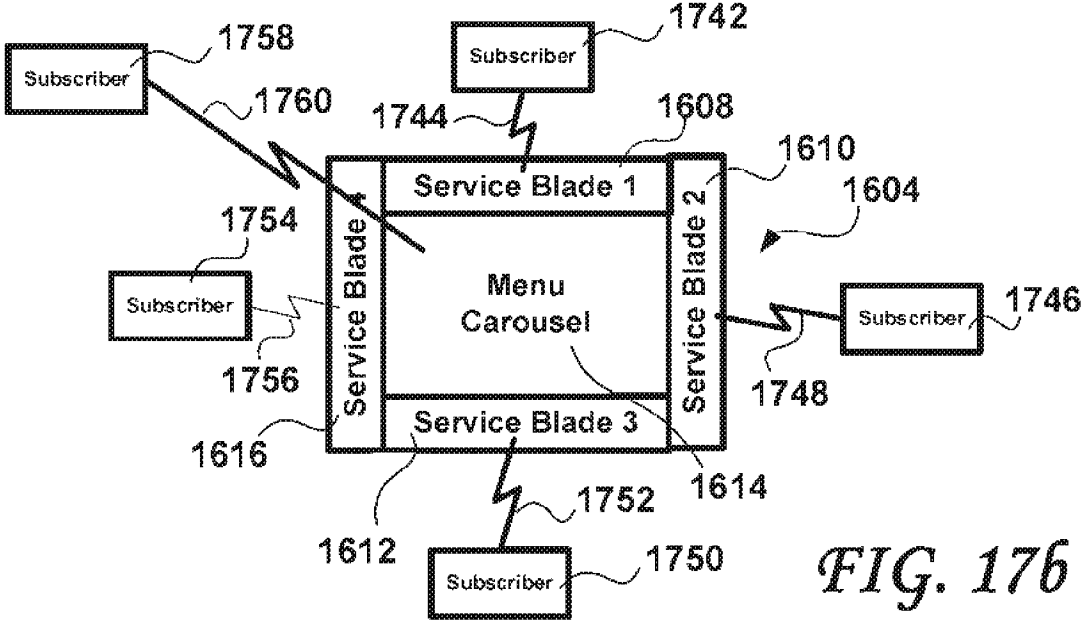
FIG. 17*b* shows further exemplary shopping carousel services provided on a main video display, according to embodiments of the present invention.

FIGS. 17*a* and 17*b* further illustrates an exemplary set of shopping carousel services. The services shown are split between a top video display 1602 (FIG. 17*a*) and a main (e.g., lower) video display 1604 (FIG. 17*b*). Alternatively, these services may be arranged in any fashion depending on the real estate of video display available on the gaming machine (e.g. a single 32" display in portrait mode, two 20" displays, two 20" displays and a separate 7"' display for player tracking services, to name but a few of the possibilities).

The subscriber 1712 may be or include a computing resource containing 6-second (for example) video promotion clips of currently or soon to be available games, the computing resource subscribing to, consuming and providing services (via a tightly-coupled or a loosely-coupled connection 1714) such that the clips are shown on the "Promo 1 Service" touch-screen display region 1704 of the top video display 1602. The player may interact with subscriber 1712 via the touch-screen region 1704, as is described hereunder.

In like fashion, the subscriber 1716 may be or include a computing resource containing 10-second (for example) video promotion clips of casino services such as SPA, massage, restaurant bar, beverage, jewelry, etc., the subscriber 1716 (a computing resource) subscribing to, consuming and providing services (via a tightly-coupled or a loosely-coupled connection 1718) such that the clips are shown on the "Promo 2 Service" touch-screen display region 1708 of the top video display 1602. The player may interact with subscriber 1716 via the touch-screen display region 1708, as is described hereunder.

Similarly, the subscriber 1720 may be or include a computing resource for streaming (for example) video of live sport events, news and/or documentaries, the subscriber (computing resource) 1720 subscribing to, consuming and providing services (via a tightly-coupled or a loosely-coupled connection 1722), such that the video streaming is shown on the "Promo 3 Service" display region 1710 of the top video display 1602. The player may interact with subscriber 1720 via the touch-screen region 1710, as also described below.

It is to be noted that the touch-screen display regions 1704, 1708 and 1710 may be resized, moved and/or hidden or rendered selectively visible, under the control of (for example) their respective subscribers 1712, 1716 and 1720. Likewise, the touch-screen display regions 1704, 1708 and 1710 may be resized, moved and/or selectively rendered visible or hidden via configuration parameters (e.g., via an onscreen menu) set by the game operator and/or by the player.

Turning now to FIG. 17*b*, the subscriber 1742 may be or include a login computing resource subscribing to, consuming and providing services (via a tightly-coupled or a loosely-coupled connection 1744), such that login is shown in the region of the display labeled "Service Blade 1" 1608. The player may interact with subscriber 1742 to provide his or her login credentials via the touch-screen region labeled "Service Blade 1" referenced at numeral 1608.

Similarly, the subscriber 1746 may be or include a hospitality computing resource subscribing to, consuming and providing services (via a tightly-coupled or a loosely-coupled connection 1748), such that hospitality information is shown in the region of the display labeled "Service Blade 2" 1610. The player may interact with subscriber 1746 to browse and/or purchase hospitality services via the region of the touch-screen display labeled "Service Blade 2" referenced at numeral 1610.

Likewise, the subscriber 1750 may be or may include a search computing resource subscribing to, consuming and providing services (via a tightly-coupled or a loosely-coupled connection 1752) such that search information is shown in the region of the display labeled "Service Blade 3" 1612. The player may interact with subscriber 1750 to search (for games to play on the gaining machine) according to inputted search criteria, via the region of the touch-screen display labeled "Service Blade 3" 1612.

In like fashion, the subscriber 1754 may be or include a player tracking computing resource subscribing to, consuming and providing services (via a tightly-coupled or a loosely-coupled connection 1756) such that player tracking information is shown in the "Service Blade 4" 1616 region of the touch-screen display. The player may interact with subscriber 1754 for accessing the player tracking services via the region of the touch-screen display labeled "Service Blade 4" 1616.

For each of the subscribers 1712, 1716, 1720, 1742, 1746, 1750, 1754 and 1758 (discussed hereunder), player interaction with the associated respective touch-screen display regions causes services to be provided to the subscriber associated with the touch-screen display region with which the player has interacted. The provided services are then consumed by the subscriber, which then may provide services requested by the player. Those services may then be consumed by the gaming machine (and more particularly consumed by the Promo 1, 2 or 3 Service 1704, 1708 and 1710 or by one of the service blades 1, 2, 3 or 4, referenced at numerals 1608, 1610, 1612 and 1616), which causes the requested content to be displayed in the touch-screen display region with which the player has interacted. The subscribers, therefore, subscribe to services that are provided by the gaming machine as a result of player interactions, consume those services and, in turn, provide corresponding services back to the gaming machine which consumes the provided services and causes the requested content to be displayed in the appropriate region(s) of one or more of the displays of the gaming machine.

It is to be understood that the descriptions above relative to the Promotional Touch-screen display regions 1704, 1708, 1710 and the service blades 1608, 1610, 1612 and 1616 are for exemplary purposes only, and that the present inventions are to be limited thereby. Indeed, those of skill in this art will readily recognize mat each of the regions and service blades may be configured differently than described herein, may be different in number, size, orientation and appearance. For example, a gaming machine need not include each of the service blades 1608, 1610, 1612 and 1616. Moreover, the regions and service blades may be configured to subscribe to and consume network services that are different from those illustrative services described herein. Indeed, casino operators and gaming machine manufacturers will likely find other innovative configurations and services for the promotional regions and service blades described herein, and all such variations are deemed to fall within the scope of the embodiments disclosed and defined herein.

Each of the video regions of the service blades 1608, 1610, 1612 and 1616 may advantageously (but need not) be rectangular in shape so as to appear as a blade. Each, blade may be selectively visible or hidden under the control of the associated subscriber resource, under the control of a selected service and/or under the control of a player interaction (e.g. a button on the front panel, a menu command, an event while playing a game). An animation may be provided to bring a blade from a hidden status to a visible status (and vice-versa). Such animation may take the form of, for example, a pop-up, gradual transparency pop-up, sliding, as those in graphic arts will recognize.

To minimize the obtrusiveness of the blades as they are brought to visible status, the central menu carousel 1614 may be progressively resized as a blade is opening (and vice-versa), such that the entire original content of the menu carousel 1614 is always visible. When multiple blades open, the central menu carousel 1614 may be accordingly progressively resized. Alternatively, a blade may use progressive alpha-blending when opening with partial opacity such that entire original content of the menu carousel is always visible behind.

Similarly, in order to minimize the effect on the game being played as a blade or blades are opening or rendered visible, the windows in which the game is being displayed may be progressively resized as a blade is opening (and vice versa), such that the entire original content of the game is always visible. When multiple blades open, the game may be accordingly progressively resized. Alternatively, a blade may use progressive alpha-blending when opening with partial opacity such that entire original game is always visible behind while the player is playing.

The subscriber 1758 may be or may include a game gadget (e.g., a mini-application containing attractive graphics or animations) computing resource subscribing to and consuming the services of the menu carousel 1614 (via a tightly-coupled or a loosely-coupled connection 1760) such that animated selection gadgets are shown on the center region of the menu carousel 1614. The player may interact with subscriber 1758 to select a game to play via the touch-screen functionality in the display region of the menu carousel 1614.

Figure 18:
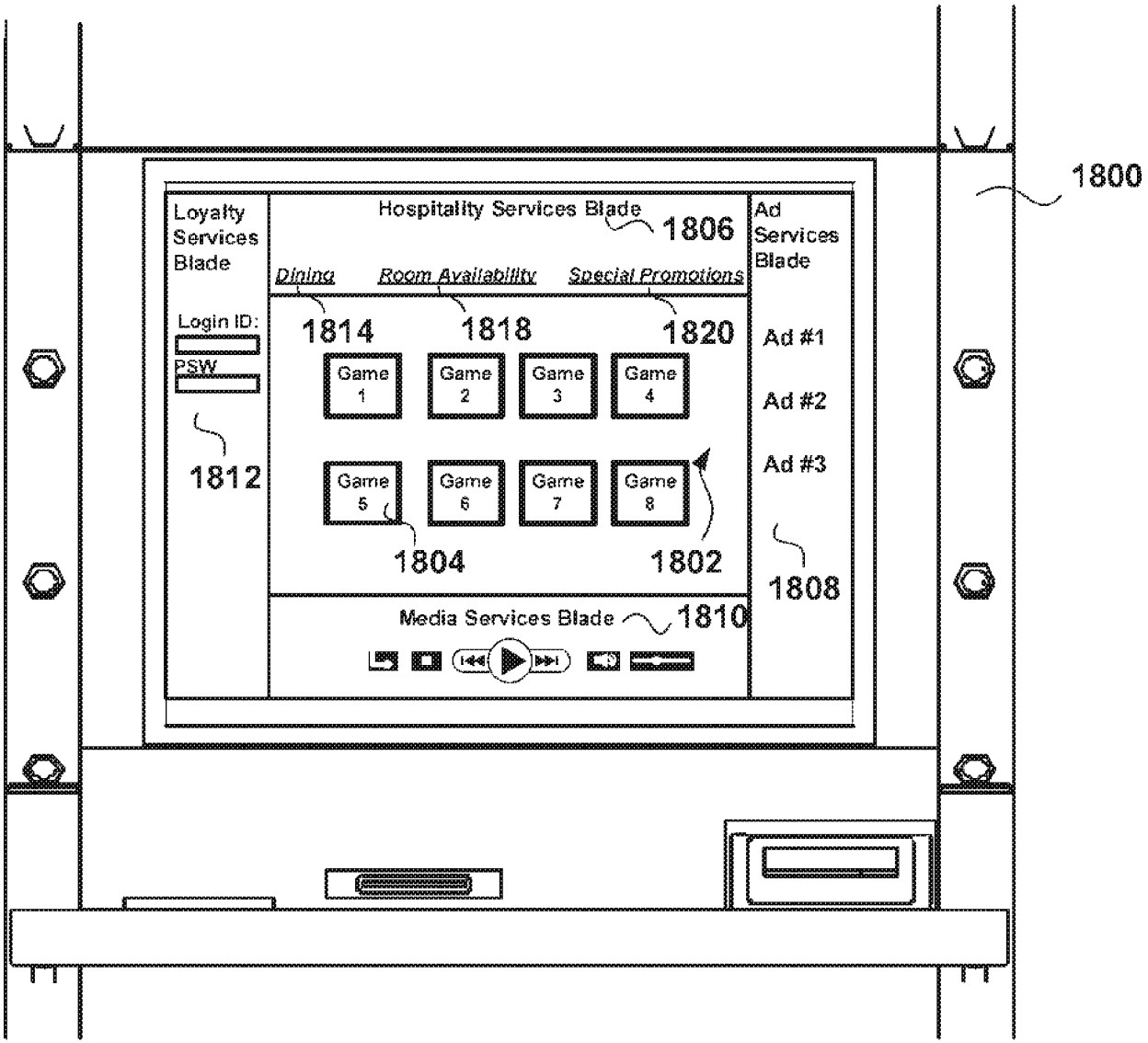
FIG. 18 depicts an exemplary gaming screen in a dynamic player interface in which four service blades have been deployed simultaneously on a gaming machine, according to embodiments of the present inventions.

FIG. 18 depicts an exemplary gaming screen in a dynamic player interface in which four service blades have been deployed simultaneously on a gaming machine 1800, according to embodiments of the present inventions. In this example, the menu carousel 1802 in the center gaming screen displays a 2D menu carousel that has been resized to accommodate the four service blades 1806, 1808, 1810 and 1812. On the top of the screen, a Hospitality Services Blade 1806 allows players to view information and promotions pertaining to rooms and food and beverage within the casino's hotel operation (e.g., dinning 1814, room availability 1818 and special promotions 1820). On the left of the screen, a Loyalty Services Blade 1812 allows player to sign into a player loyalty program and view their loyalty points status, promotions available to them based on loyalty, and any other information related to or associated with their loyalty program. On the bottom of the screen, a Media Services Blade 1810 allows players to exert controls over the top screen content running on the machine (they may, for example, watch, sporting events miming in the Sportsbook, view promotions, or even watch premium movies or standard television). On the right of the screen, an Advertisement Services Blade 1808 allows the casino to generate revenue by running advertisements on behalf of third party groups such as game developers, local services, and the like. It should be noted that the four sample service blades depicted in FIG. 18 are merely examples of possible configurations. Because game operators own the content contained within their service blades, the uses to which such blades may be put are effectively limitless. The menu carousel 1802 may allow the display of animated game gadgets 1804 or icons, each representing a game for the selection of games. To play one of the displayed games on the gaming machine 1800, the player may simply select the chosen game via the touch-screen functionality of the display, whereupon the gaming machine 1800 would enable game play of the selected game.

Figure 19:
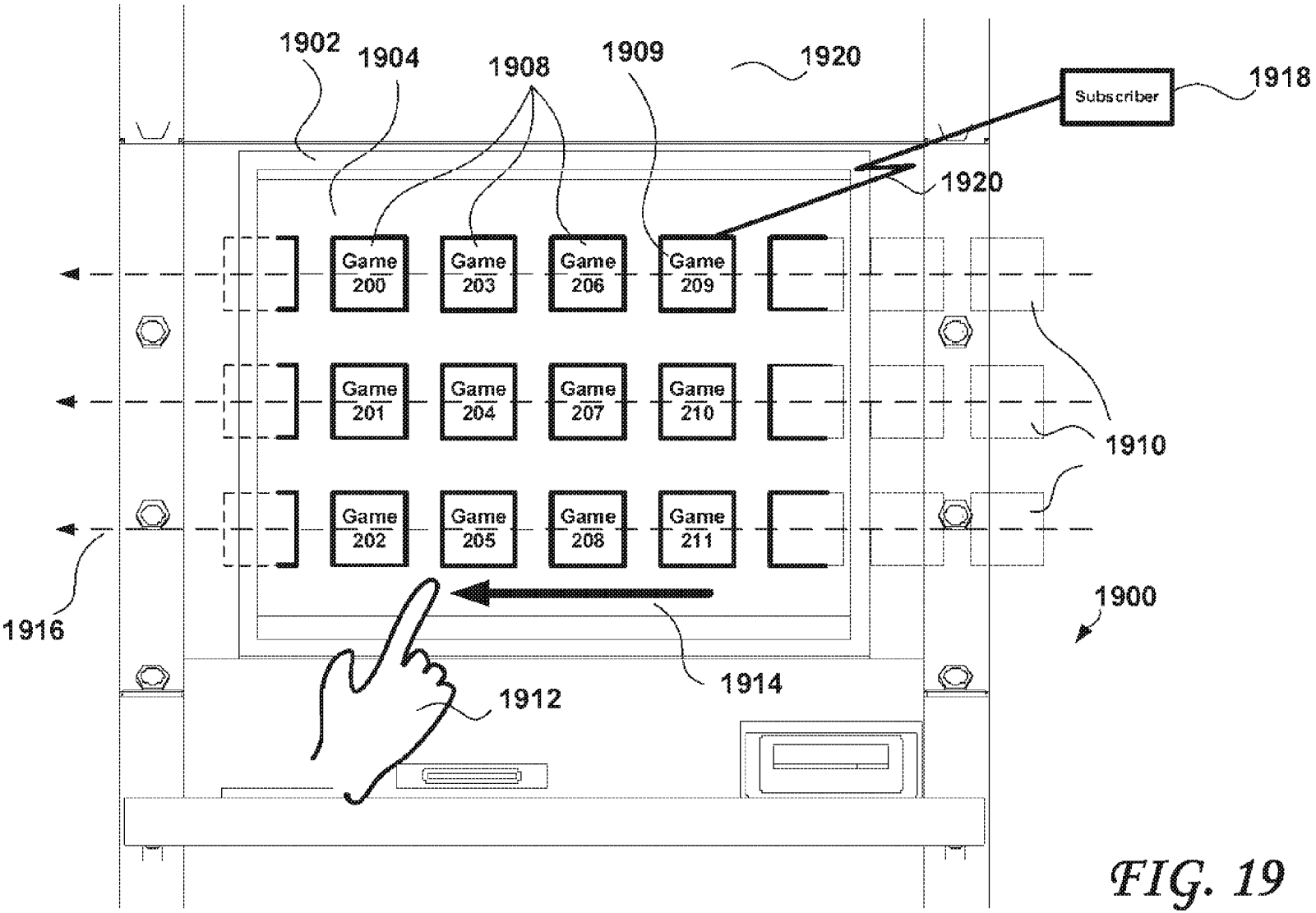
FIG. 19 depicts one possible 2D menu carousel displayed on a main display of a gaming machine, according to an embodiment of the present inventions.

FIG. 19 depicts one possible 2D menu carousel 1904 displayed on the main display 1902 of the gaining machine 1900, according to an embodiment of the present inventions. In the depicted model, players are able to view and select at any time from 12 games each represented by a game gadget 1908, 1909 (Game 200 to Game 211). However, more than 12 games may be available and player selectable. That is, not all of the available games may be displayed at any given time in the menu carousel 1904. Accordingly, the menu carousel 1904 may be configured to enable the players to scroll through the available games by, for example, initiating a sweeping motion 1914 across the touchscreen with their finger 1912, sweeping onscreen games towards the left to reveal new games whose game gadgets 1910 are hidden at the right and ready to be exposed. As the menu carousel is being scrolled and the game gadgets slide to the left as a result of the player's sweeping motion 1914 (by a video animation), the game gadgets on the left border of the display will disappear off the screen to the left, as suggested at 1916. The symmetrical scenario may occur when the player swipes his finger to the right in the other direction (not shown), thereby causing the displayed game gadgets to move to the right and eventually disappear from the screen as new, previously unseen game gadgets appear on the left of the screen. In some embodiments of the invention, players may view alternate game options by sweeping the games featured onscreen up or down (not shown). The menu carousel scrolling video animation may track the position of the finger being swept across the touchscreen. On downloadable gaming machines having hundreds games available, this sweep-to-scroll menu allows the player to quickly and intuitively through the hundreds of corresponding game gadgets. Of course, the scrolling of the menu of game gadgets may be initiated by mechanisms other than a player sweeping his or her finger across a touchscreen. For example, "Scroll Right" and "Scroll Left" buttons (mechanical or onscreen) may be provided to achieve the same functionality. Other solutions may occur to those of skill in this art, and all such solutions are deemed to fall within the scope of the present inventions.

Each of the game gadgets may be configured as a service provider and as a service consumer. For example, subscriber 1918 may be a computing resource for controlling what is displayed on the game gadget 1909 (Game 209), the subscriber 1918 (a computing resource) subscribing to and consuming the menu button services of game gadget 1909 (via a tightly-coupled or a loosely-coupled connection 1920) such that an animation is shown on the display region of the top screen 1902. The player may interact with subscriber 1918 via the region of the touch-screen display occupied by game gadget 1909. In this scenario, the player interaction with the game gadget 1909 causes menu button services to be provided to and consumed by the subscriber 1918. Responsive thereto, the subscriber 1918 provides menu button services, which are then consumed by the game gadget 1909, to cause the game gadget to start the game associated with the game gadget 1909, to show additional information to the player, to enable a game preview or to carry out another action or function, as described herein below.

For example, an attractive icon-size video animation (e.g., a wolf running) of a complete wild animal theme game may be displayed on the game gadget, and selecting the game gadget would start the game (or cause the display of a secondary menu). The icon-size video animation may be controlled by the computing resources mat subscribe to the services provided by the selected game gadget. In accordance with predetermined scheduling criteria, the computing resource may change the video animation to, for example, a jumping dolphin, thus causing a marine theme game (or a secondary menu to be activated) to be started when the game gadget (which may be thought of as a button within the menu carousel) is selected by a player. The menu carousel buttons may each be a different size and shape (square, round, triangular, etc.). A schedule change for a button animation may be according to the location of that button on the menu carousel.

The game operator may tailor the appearance and behavior of the shopping carousel to best accommodate the players. Game operators may configure the gaining machines according to embodiments of the present inventions to appeal to older players by causing the games to launch when they are selected (i.e., upon the player touching the game icon or icon animation button on the menu carousel). Alternatively, game operators may configure the gaming machine to appeal to younger players that desire a greater degree of control over their gaming experience by causing the games to present a sub-menu when selected, the sub-menu featuring additional options like denomination, style of play, language, among other possible customizable features of the selected game.

Game menus presented on the menu carousel may be structured intelligently such that the most popular games appear initially within the currently viewable portion of the menu carousel. Game popularity data may be acquired in a number of ways, including but not limited to: win per day metrics, player ratings, and average time on device metrics, for example. The most popular game may be the games that are most popular across players or the games currently favored by the player. Indeed, when a player tracking card is inserted, the player profile data recorded in the central database may automatically configure the menu carousel such that the player's favorite games (or those games that are believed to be likely to satisfy the player's preferences) are presented by default or appear in priority when scrolling the menu carousel.

Figure 20:
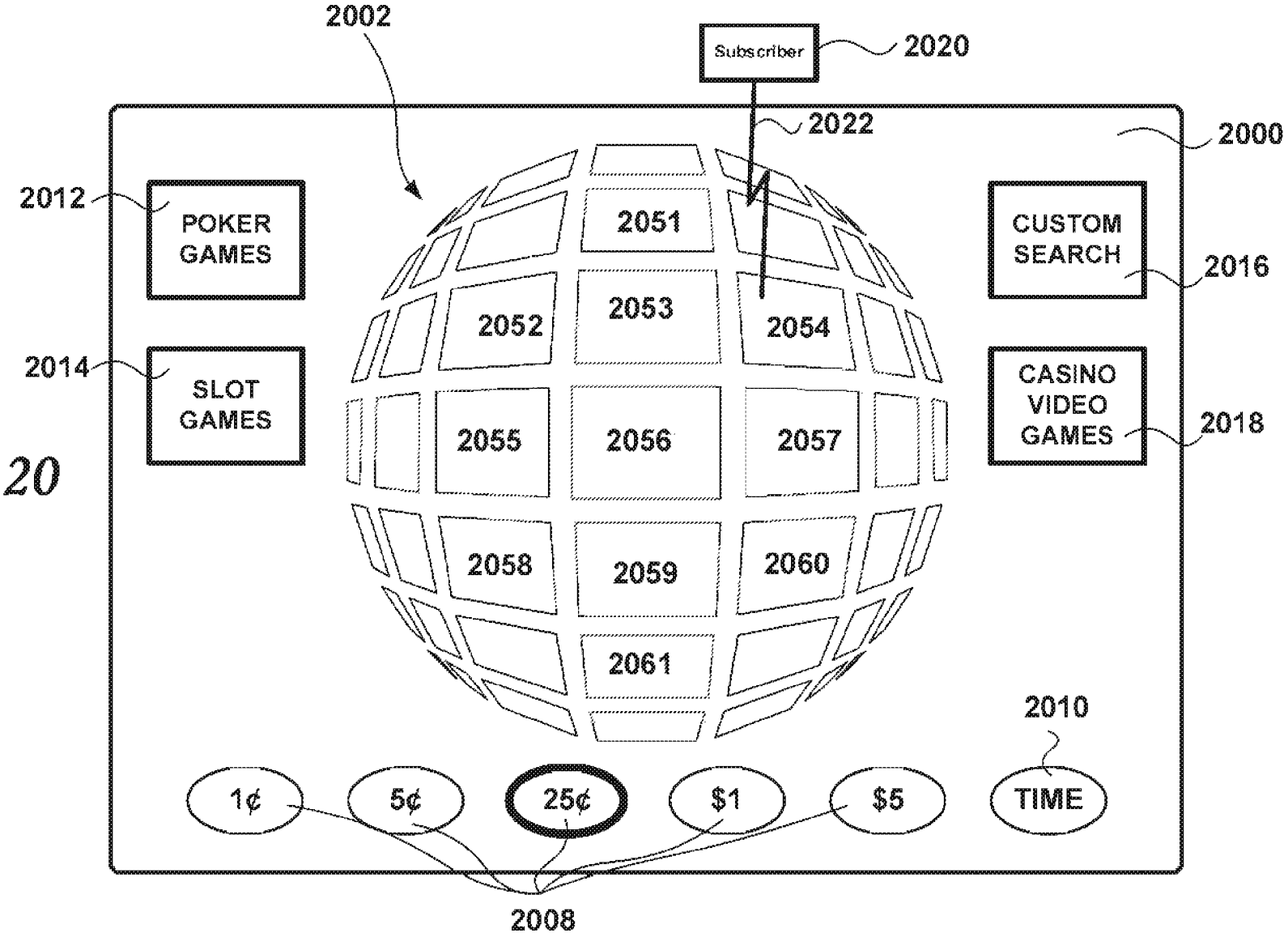
FIG. 20 depicts one possible 3D menu carousel, according to an embodiment of the present inventions.

FIG. 20 depicts one possible 3D menu carousel according to an embodiment of the present inventions. In this interface, games are presented in a 3D orb-like (e.g., a globe or a sphere, spheroid or other surface of revolution such as a cylinder, for example) display 2002 that may be rotated (for example, either left or right, up or down or diagonally) or otherwise moved by the player to reveal new game offerings via player selectable game gadgets (2051-2061). When selected, the game gadgets 2051-2061 may enable the player to play a game associated with the selected game gadget and/or may provide the player with additional information regarding the associated game such as, for example, a preview of the associated game or other relevant game information. Moves by the 3D orb-like display 2002 may be initiated by a four-way sweeping motion (right/left/up/down or diagonally) on the touchscreen by the player's hand or finger or fingers in an intuitive fashion that allows players to rapidly preview a large amount of game icons or icon animations. Alternatively, buttons (either displayed or mechanical) may be provided which, when depressed by the player, cause the 3D orb-like display 2002 to rotate to hide some game gadgets and to reveal others.

Players may manually rotate the 3D orb-like display 2002 and look at the game gadgets as they are sequentially revealed. Alternatively, players may formulate a search for the desired game. For example, players may narrow their searches by selecting a single or multiple game characteristics. For example, the player may search for games of a selected game denomination 2008 on the main menu such mat only games available in the chosen denomination (e.g., 25¢ games) are displayed in the 3D orb-like display 2002. Players also further narrow their searches by selecting a game style—time gaming 2010 vs. standard play for example—on the main menu such that only games available in that game style are displayed. Players may also initiate "quick searches" by touching one or more filter or dedicated buttons on the interface. In the depicted example, the player may press the POKER GAMES button 2012 to view only poker game selections, the player may touch the SLOT GAMES button 2014 to view only slot game selections, or the player may touch the CASINO VIDEO GAMES 2018 button to view only next generation casino games. Operators may also choose to make available a CUSTOM SEARCH button 2016 that would allow the player to view only games matching search terms they input. By selecting, for example, both the SLOT GAMES button 2014 and the 25¢ button, the player may cause the 3D orb-like display 2002 to show only game gadgets for 25¢ slot games. Other dedicated buttons may be provided such as, for example, for Scripted Multi-Act Games. Moreover, selecting one of the dedicated buttons may cause further choices to be presented to the player. For example, the CASINO VIDEO GAMES 2018 may cause the display of further buttons such, as, for example, DRIVING GAMES, FIRST PERSON SHOOTER GAMES, SPACE-BASED GAMES, etc. The dedicated buttons may be programmable by the operator to fit special events, a predetermined demography, the time of day, or any other criteria.

Each of the game gadgets on the 3D orb-like display 2002 may be configured to be a service consumer and provider. For example, subscriber 2020 may be a computing resource for controlling what is displayed on the game gadget 2054, the subscriber 2020 (a computing resource) subscribing to, consuming and providing the menu button services of 2054 (via a tightly-coupled or a loosely-coupled connection 2022) to enable, for example, an animation to be shown on the display region of the menu button (game gadget) 2054. The player may interact with subscriber 2020 via the touch-screen region occupied by the game gadget 2054, to provide services that are consumed by the subscriber 2020 which, in turn, provides services that are consumed by the game gadget 2054 which then displays the requested content according to the consumed services.

It is to be noted that orbs or spheres are not the only 3D shapes onto which the menu carousel may be projected. Other three-dimensional shapes may be adapted for a similar purpose. For example, an irregularly shaped planetary body like object may be adapted for use as a menu carousel. Surface textures and colors may be rendered on such a 3D shape to enhance the player's gaming experience. For example, game gadgets for space-based games may be projected onto such an irregularly shaped planetary body to simulate an asteroid or other deep space object. The appearance of the menu carousel may change, therefore, according to the game gadgets being displayed thereon, the time of day or night, and/or any other characteristics selected by the player, game manufacturer or casino operator.

Figure 21:
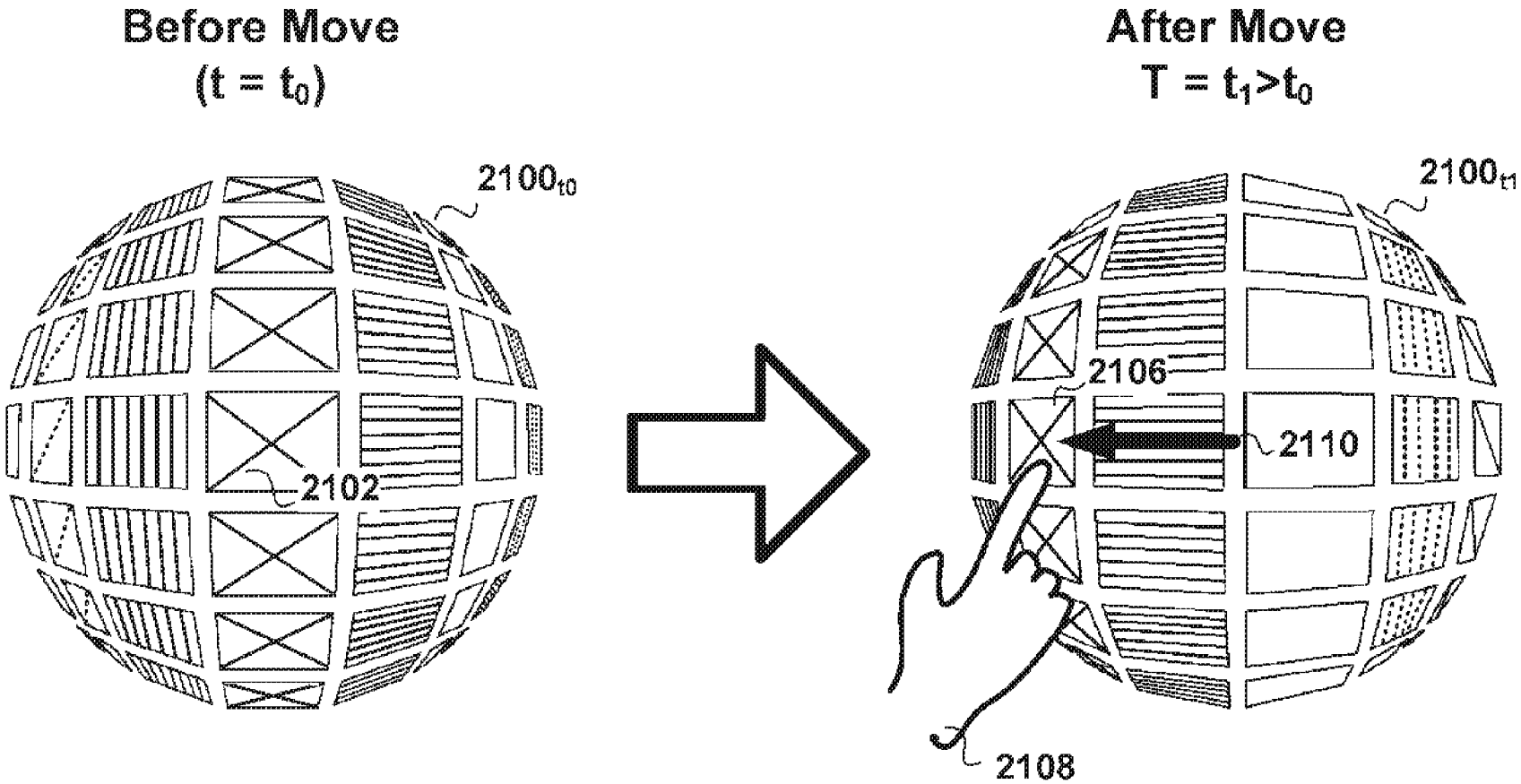
FIG. 21 demonstrates how the player may use a sweeping motion to navigate game menus in a 3D dynamic menu carousel, according to embodiments of the present inventions.

FIG. 21 demonstrates how the player may use a sweeping motion to navigate game menus in a 3D dynamic menu carousel (such as the above-described orb-like display 3802), according to embodiments of the present inventions. For the purposes of illustration, each, column of game gadgets on the depicted 3D game menu carousel $\mathbf{2100}_{t0}$ and $\mathbf{2100}_{t1}$ has been assigned a common image pattern. In the depicted example, all games in the middle column of the "Before Move" version of the game menu carousel $\mathbf{2100}_{t0}$ have been marked with an "X" pattern 2106.

The player may move the orb and reveal new game gadgets (and simultaneously hiding other game gadgets) by performing an intuitive sweeping motion 2110 across the screen by sweeping his linger 2108 on the touch-screen. In the "After Move" section of FIG. 21, the player has made a short, leftward sweep 2110. As a result, the orb rotates to the position depicted at $\mathbf{2100}_{t1}$ (wherein $t_1$ is later in time relative to $t_0$) those game gadgets in the center column (marked with an "X" 2106) have moved two positions to the left and two new columns (one marked with vertical dotted lines and one marked with a single diagonal line) have now become visible. The player may continue this motion to scroll through a game operator's entire gaming library. In addition, the player could perform sweeps in other directions (right, up, down and optionally even diagonally) to see new gaming choices or return to gaming choices that were previously viewed.

Figure 22:
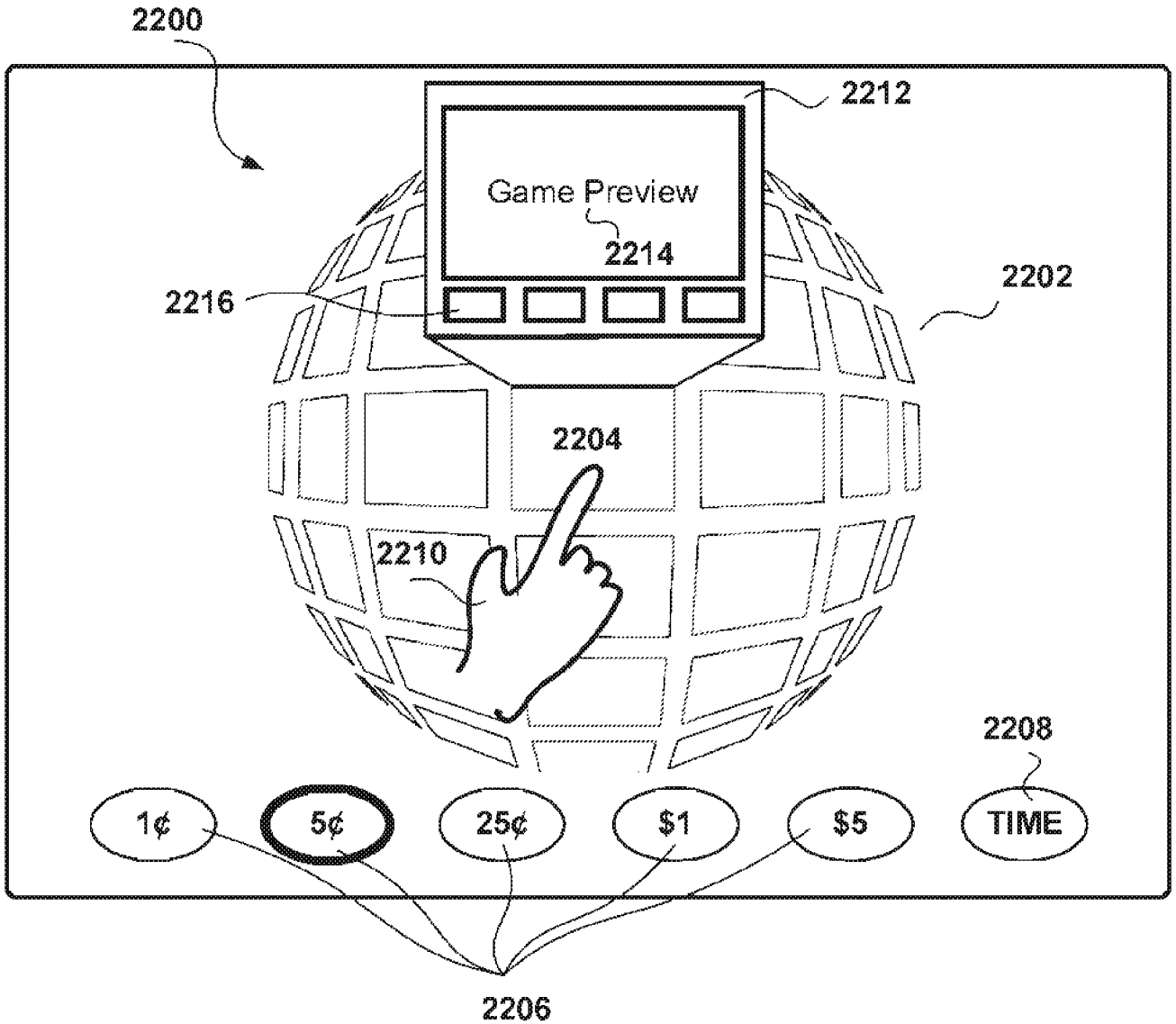
FIG. 22 demonstrates how a 3D menu carousel may make use of advanced touch-screen technology to offer players a game preview feature, according to embodiments of the present inventions.

FIG. 22 demonstrates how a 3D menu carousel 2200 may make use of advanced touchscreen technology to offer players a game preview feature, according to embodiments of the present inventions. In this model, the player may interact with a static game icon or icon animation or a game gadget 2204 appearing in the menu carousel 2202 in different ways. According to one exemplary embodiment, when a player selects a game by firmly touching as suggested at 2210 (or touching for an extended duration) the game gadget 2204, a play sequence is then launched, which play sequence may include entering a sub-menu for that game or launching the game directly. Alternatively, when the player engages in a second type of interaction with the game gadget button 2204; for example by lightly touching it (or briefly touching it), a popup 2212 may be launched. The popup 2212 may include a brief preview 2214 of the game corresponding to the selected game gadget. Such a brief preview 2214 may feature promotional animations, simulated game play, or static images. The brief quick preview screen may comprise selection buttons 2216. The game preview feature 2214 may also be used to provide the player with other information concerning the game associated with the selected game gadget such as, for example, game statistics, paytables, help menus and the like. Indeed, the information provided to the player via the popup is effectively unlimited. For example, the popup may provide the player with the last time he or she played that game, the amount won or lost, or how "lucky" that game has been in the recent past. Game operators, players and casino operators will undoubtedly find other uses for the popup that appears when one of the game gadgets of a menu carousel is selected, and all such uses are deemed to fall within the scope of the inventions disclosed herein.

Figure 23:
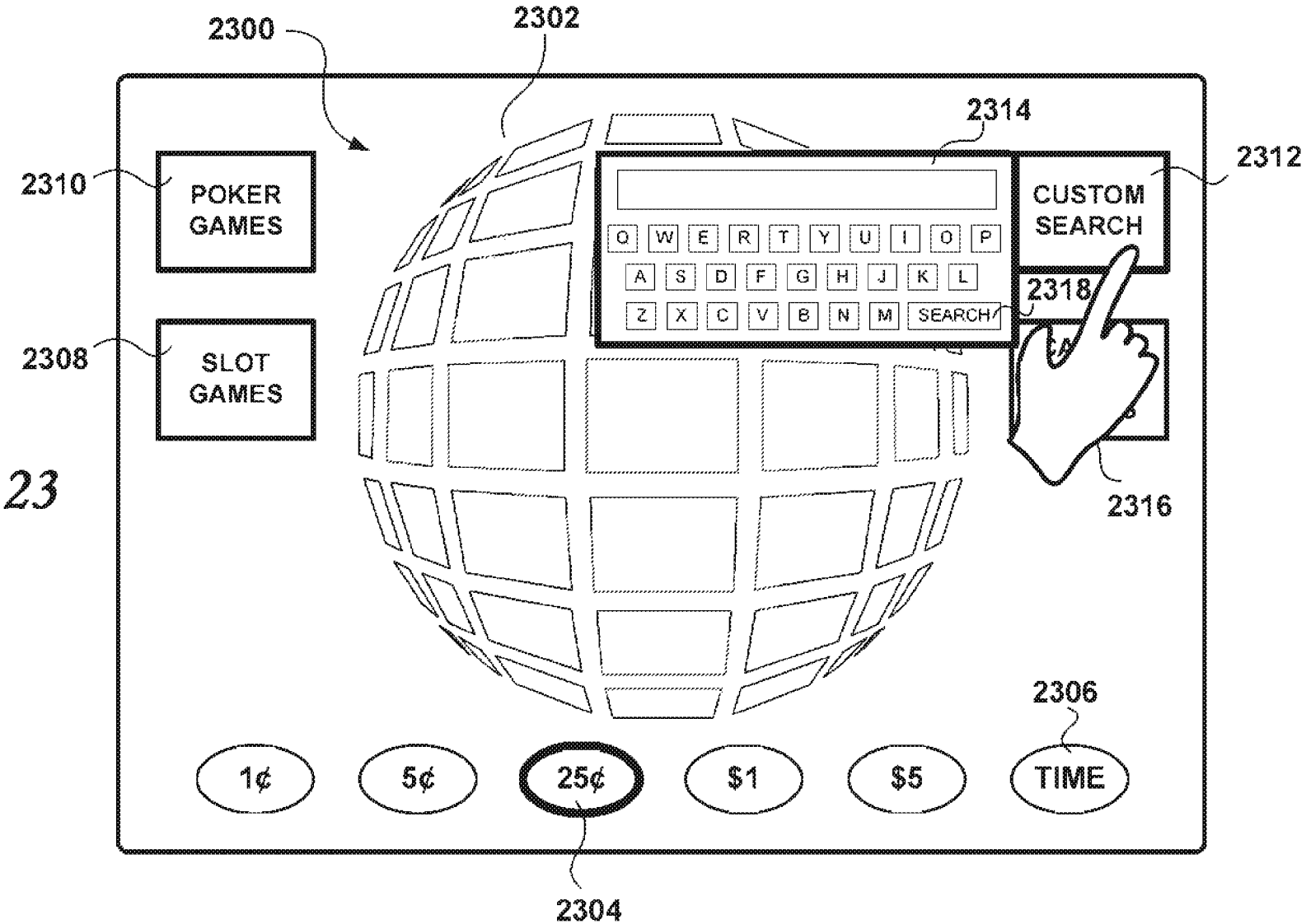
FIG. 23 demonstrates how players may make use of a CUSTOM SEARCH button to find the games they wish to play quickly, according to still further embodiments of the present inventions.

FIG. 23 demonstrates how players may make use of a CUSTOM SEARCH button 2312 to find the games they wish to play quickly, according to still further embodiments of the present inventions. In this model 2300, when the player 2316 presses the custom search button 2312, a keyboard 2314 may be launched in, for example, a pop-up window. The keyboard 2314 allows the player to input custom search terms to perform a keyword search. After the player inputs search terms and presses the search, button 2318, only games matching one or more of the input search terms will appear within the depicted 3D game orb menu carousel 2302. To enable such keyword searches, each game associated with a game gadget appearing on the menu carousel 2302 may include a number of game characteristics, saved as metadata. The search would then evaluate the games' metadata against the player-input search term or terms and return those games whose metadata matches the input search terms.

The custom search feature may work in conjunction with other shortcut buttons on the gaming interface. For example, a player who has input a custom search for a "Jungle" themed game, may also press the 250 denomination (denom) button 2304 and the Time button 2306, so that only timed games having a Jungle theme that are available for 25¢ play are displayed within the 3D game orb menu carousel 2302. The same functionality that orders non-filtered game menus; i.e., the more popular games appear before less popular games, may also apply to filtered game menus.

Because the depicted interface is dynamic, the game operator may tailor the appearance and behavior of the menu carousel to match the current needs of their customers; namely, the players of the gaming machines configured according to one or more of the embodiments disclosed herein. For example, because custom searches require more interactivity and take time away from revenue-producing activity, operators may wish, to disable them in cases where the prevailing demographic is unlikely to make effective use thereof or in cases where their gaming libraries are not large. One key benefit of the dynamic interface described herein is that it allows operators to constantly monitor the behavior and demographic of their player base and to adjust their menus to maximize revenue generating activities such as game play and minimize non-revenue generating activities such as game selection. Furthermore, game operators may elect to use data included in an input player loyalty card to regulate the appearance and features of the menu carousel.

Figure 24:
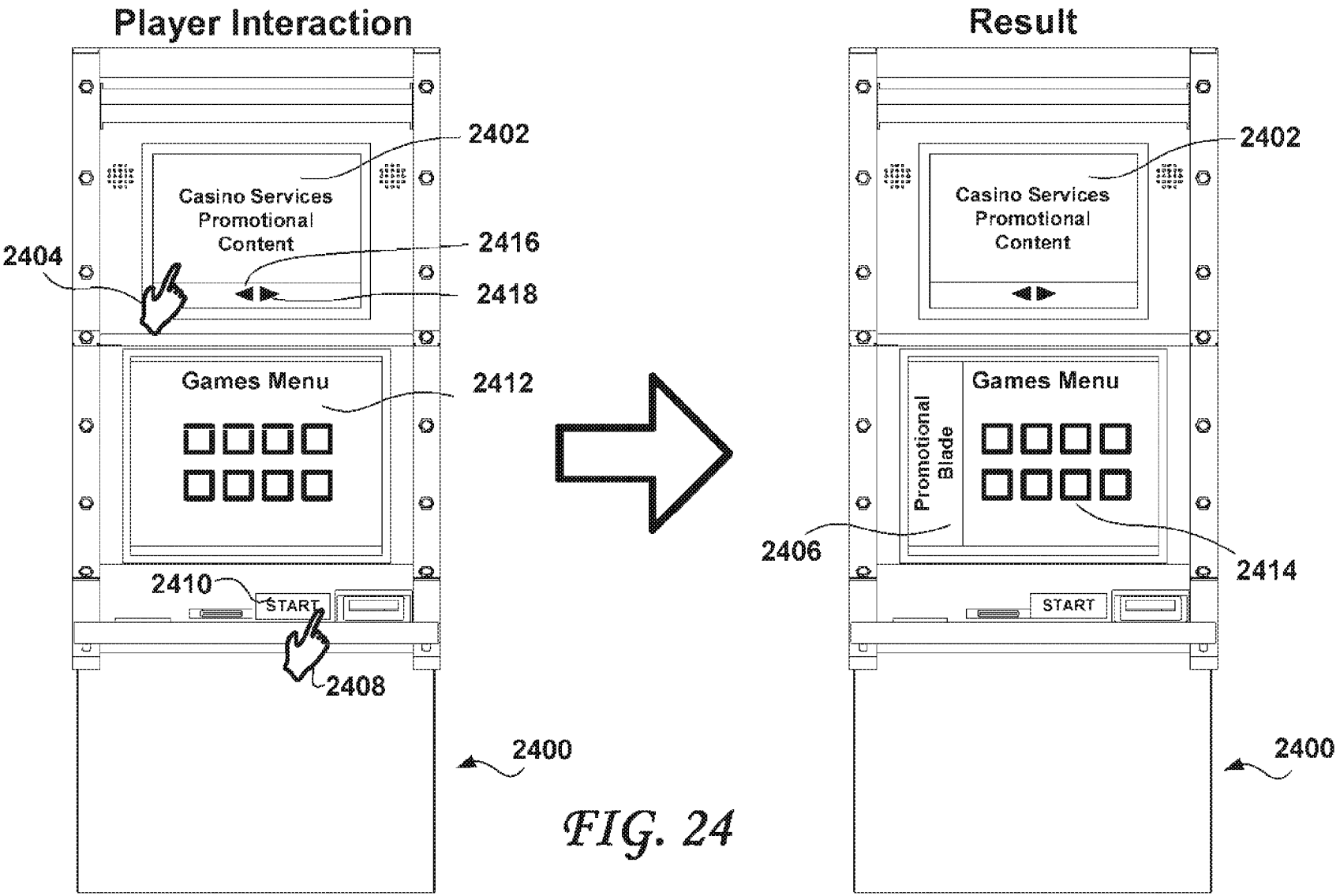
FIG. 24 shows how players may make use of simple one-touch controls to take advantage of casino promotions, according to further embodiments of the present inventions.

FIG. 24 shows how players may make use of simple one-touch controls to take advantage of casino promotions, according to further embodiments of the present inventions. In the presented dynamic interface, the gaming machine 2400 may run promotional content 2402 on their top screens or on large LCD monitors overhanging a bank of machines. This promotional content 2402 may include information about casino events, casino discounts, casino promotions as well as game advertisements, to name but a few possibilities. When a players sees a promotion that is appealing, he or she may redeem it conveniently by simply touching 2404 the top screen (where the promotion is miming) directly or by touching one or more dedicated hardware buttons on the gaming machine. When the promotional content 2402 is not a game advertisement, then a dedicated blade 2406 may appear on the gaining machine containing further information about the promotion and instructions on how the player may redeem it.

For example, if the player was playing a jungle themed slot machine and an invitation to get double rewards for joining the casino player loyalty program appears on the top screen of the gaming machine, the player could simply touch the top screen as shown at 2404 (or touch as shown at 2408 a dedicated hardware button such as the game's "START" button 2410) to open a service blade 2406 on the bottom gaming screen containing an online registration form for the player loyalty program. It is important to note that the appearance of this blade 2406 would not compromise game play or game selection since all onscreen assets 2412 would be dynamically resized to fit the now smaller portion 2414 of the bottom screen dedicated to gaming 2414.

It should also be noted that top screen toggle buttons 2416 may be made available to the player. These buttons 2416 would allow the player to exert some control over top screen content (such as the promotional content 2402) by returning to previous content for reviewing (by pressing the left toggle button 2416) or by skipping past content that is unappealing (by pressing the right toggle button 2418).

Figure 25:
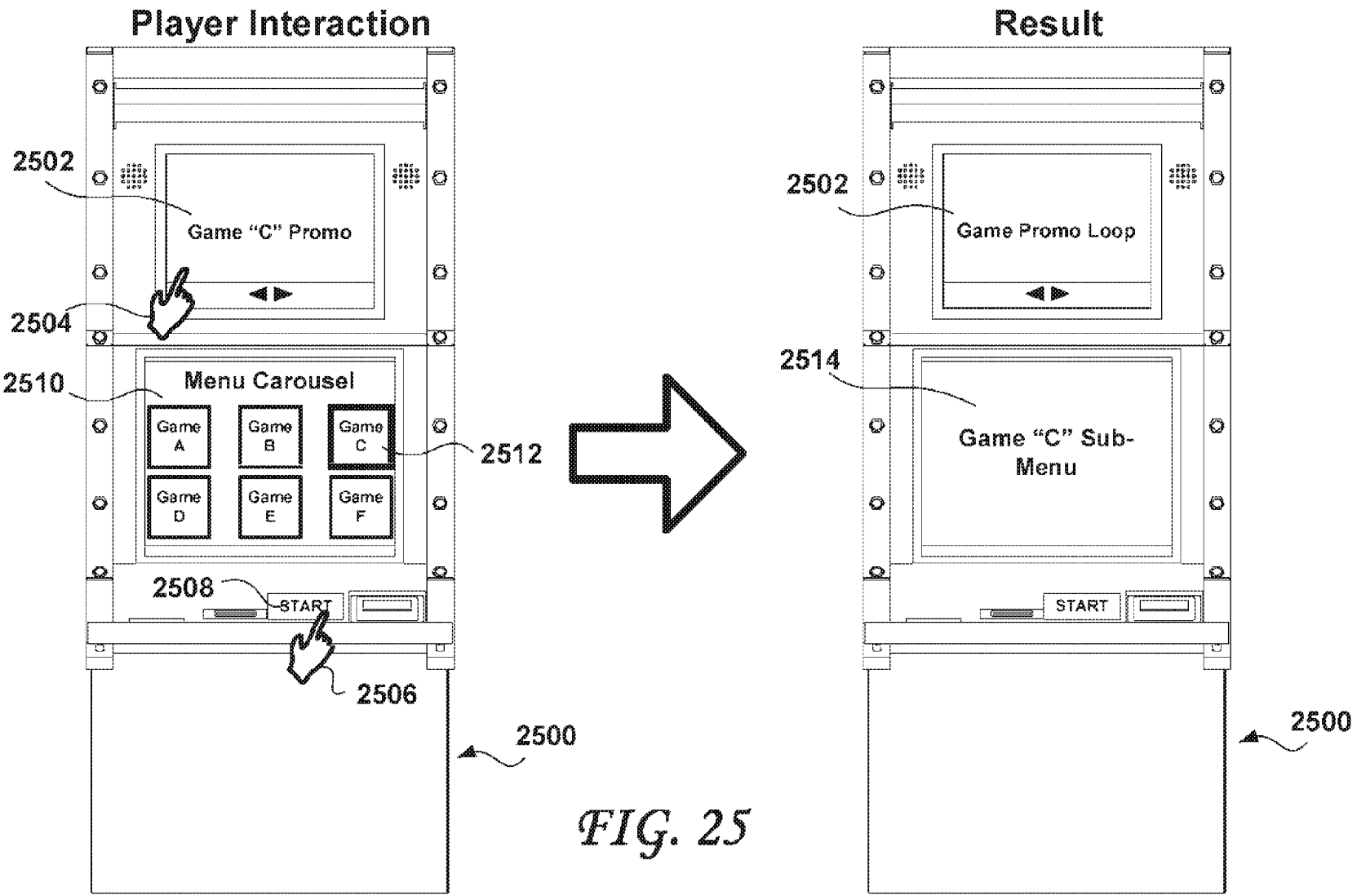
FIG. 25 demonstrates how players may make rise of simple one-touch controls to play a casino game featured in a top screen promotion, according to embodiments of the present inventions.

FIG. 25 demonstrates how players may make use of simple one-touch controls to play a casino game featured in a top screen promotion, according to embodiments of the present inventions. In the presented dynamic interface, gaming machines 2500 may run game promos 2502 on their top screens or on large LCD monitors overhanging a bank of machines. When a players sees a promotion for a game that he finds appealing, he may redeem it conveniently by simply touching the top screen (where the promotion is running) directly or by touching one or more dedicated hardware buttons on the gaming machine, as suggested at 2504. Depending on how the game operator has configured the terminal, this action will either bring the player into that game's submenu or launch the game associated with the selected promo directly (both on the bottom screen).

For example, if the player was browsing the menu carousel 2510 trying to find an appealing game and a top screen advertisement 2502 for an attractive underwater themed slot machine game C grabbed that player's attention, he could simply touch, as shown at 2504, the top screen 2502 (or touch, as shown at 2506, a dedicated hardware button such as the game's "START" button 2508) to begin playing game C on the bottom screen 2514 immediately. Optionally, a submenu for game C may be shown, to enable the player to select from available options for game C such as denomination or duration/cost of time contract.

According to an embodiment of the present inventions, when the menu carousel 2510 is being shown on the gaming machine 2500, then the game C selection 2512 may be highlighted when the promotion for game C 2502 is being displayed, to assist the player in selecting the currently promoted game C. As the menu carousel 2510 is dynamic, as shown in FIGS. 19 and 21, the menu carousel may slide or rotate as necessary for game C selection 2512 to be highlighted.

The above features deliver considerable value to game operators as they reduce the amount of time players spend navigating game menus and increase the player's ability to find the games they want to play. It also lends a never before achieved level of value to top screen promotions since players may take advantage of them much more quickly than they were able to in the past.

It is significant that the game operator have, with embodiments of the present invention, the ability to configure the behavior of the dynamic menu carousel to best suit their preferences. According to an embodiment of the inventions described herein, operators may choose to have no game promos run when a player is currently playing a game, so as not to distract the player and interrupt the revenue stream. In another embodiment, operators may choose to allow some game promos to run when a player is currently playing a game, but only promos for games with a higher casino return. In this second case, the player could take advantage of the one touch control to switch from his current game into the advertised game (after, of course, the current game is resolved and the involved funds have been credited or debited according to the outcome of the game.

As the electronic casino gaming industry continues to evolve and the size of casino gaming libraries grow exponentially, it is believed that the importance of the menu carousel paradigm presented herein will become paramount.

The presented dynamic interface allows players to use simple touch-screen controls to scroll through a large number of gaming titles efficiently. In addition, the service based menu carousel allows game operators the ability to offer players targeted marketing by having marketing computing resources on the network subscribe to the service providers available on the gaming machines (e.g. button services, blade services, etc.) and lets players interact with the promotions presented to them by using simple, one-touch controls.

As a further advantage, the depicted dynamic interface empowers casino operators or third party providers to take ownership of certain portions of each machine's gaining screen, using customized service oriented blades. These blades allow players to view and access important data including but not limited to: player loyalty data, hospitality data, and other casino marketing data.

While the foregoing detailed description has described several embodiments of this invention, it is to be understood that the above description is illustrative only and not limiting of the disclosed inventions. Indeed, a number of modifications will no doubt occur to persons of skill in this art and all such modifications should be deemed to fall within the scope of the present inventions.

What is claimed is:

1. A regulated gaming system including a plurality of computer nodes communicating over a network, at least one of the plurality of computer nodes including a gaming machine, the gaming machine comprising:

a game controller and an interactivity apparatus to accept wagers from a player and to provide random outcomes while playing a game, the interactivity apparatus including at least one video display;

a menu of available player-selectable games;

at least one option button, a function of each option button changing depending upon which of the player-selectable games is selected by the player;

a non-video display associated with each option button, the non-video display being configured to indicate at least one of a status and a function of the associated option button, and a non-video services subscriber configured to receive, over the network, selected non-video display services to which the non-video services subscriber has subscribed from a non-video display services provider executing in at least one of the plurality of nodes, the non-video display services provider being configured to provide and consume the non-video display services to and from the non-video services subscriber independently of the game controller of the gaming machine.

2. The regulated gaming system of claim 1, wherein the non-video display is configured for data refresh rates of less than about 15 data refreshes per second.

3. The regulated gaming system of claim 1, wherein the non-video display provider is further configured to consume non-video display services from the non-video services subscriber over the computer network and to control the non-video display in accordance with the consumed non-video display services.

4. The regulated gaming system of claim 1, wherein operation of the non-video display is independent of an activation of the option button.

5. The regulated gaming system of claim 1, wherein the gaming machine further includes an interactive control services subscriber and wherein an interactive control services provider executes in at least one of the plurality of nodes to provide selected interactive control services to and control the interactive control services subscriber over the network.

6. The regulated gaming system of claim 5, wherein the interactive control services subscriber is independent of the non-video services subscriber.

7. The regulated gaming system of claim 5, further comprising a high level module that is coupled to the interactive control services subscriber and to the non-video services subscriber such that activation of the option button causes the interactive control services subscriber to communicate with the non-video services subscriber via the high level module and the non-video display services provider to consume non-video display services from the non-video services subscriber and to control the non-video display to update according to the consumed non-video display services.

8. The regulated gaining system of claim 5, wherein the interactive control services subscriber and the non-video services subscriber are combined into an interactive control and non-video services subscriber, and wherein the non-video display services provider and the interactive control services provider are combined into an interactive control and non-video display services provider that is coupled to the single interactive control and non-video services subscriber over the network.

9. The regulated gaming system of claim 5, wherein the interactive control service provider includes all necessary computer, electronics and software to provide and consume the interactive control services to and from the interactive control services subscriber.

10. The regulated gaming system of claim 9, wherein the interactive control service provider is configured to provide and consume the interactive control services independently of the game controller of the gaming machine.

11. The regulated gaming system of claim 1, wherein the non-video display is disposed at least partially over the option button.

12. The regulated gaming system of claim 1, wherein the non-video display includes an organic light emitting diode (OLED).

13. The regulated gaming system of claim 1, wherein the option button is configured to be controlled by the game controller.

14. The regulated gaming system of claim 1, wherein the option button includes a button housing and a button plunger, and wherein the non-video display is unattached to the button housing and unattached to the button plunger.

15. The regulated gaming system of claim 1, wherein the option button includes a button plunger, and wherein the non-video display is attached to the button plunger.

16. The regulated gaming system of claim 1, wherein the gaming machine includes a front panel plate and wherein the non-video display is attached to the front panel plate, the option button being disposed at least partially over the non-video display and including an at least partially transparent portion such that the non-video display is viewable therethrough.

17. The regulated gaming system of claim 16, wherein the non-video display services provider is coupled to the front panel plate.

18. The regulated gaming system of claim 1, wherein the gaming machine includes a front panel plate and wherein the option button comprises leg portions that are configured to extend through openings defined in the front panel plate, the option button including a top portion that is at least partially transparent and wherein the non-video display is coupled to an underside of the top portion such that the non-video display is viewable therethrough.

19. The regulated gaming system of claim 1, wherein at least one of a function and a status of the option button is also configured to change during game play of the game selected by the player.

20. A method, comprising:

providing a gaming machine in a regulated gaming system including a plurality of computer nodes communicating over a network, the gaming machine comprising:

a game controller and interactivity apparatus to accept wagers from a player and to provide random outcomes while playing a game, the interactivity apparatus including at least one video display;

a menu of available player-selectable games;

at least one option button, and an interactive control service provider configured to control the at least one option button and to provide interactive control services over the network to an interactive control services subscriber executing in one of the plurality of computer nodes, the interactive control services provider being configured to provide and consume the interactive control services to and from the interactive control services subscriber independently of the game controller and interactivity apparatus:

a non-video display associated with each option button, the non-video display being configured to indicate at least one of a status and a function of the associated option button;

receiving a selection, from the menu of available player-selectable games, of a game from the player;

setting the function of each option button depending upon the game selected by the player;

providing non-video display services over the network to a non-video display services subscriber executing in one of the plurality of computer nodes;

subscribing to non-video display services provided by a non-video display services provider executing in one of the plurality of computer nodes;

consuming non-video display services provided by the non-video services provider over the network, and controlling the non-video display to display at least one of a status and the set function according to the consumed non-video display services provided by the non-video services provider.

21. The method of claim 20, wherein the providing step is carried out with the non-video display being configured for data refresh rates of less than about 15 data refreshes per second.

22. The method of claim 20, wherein the providing step is carried out with an operation of the non-video display being independent of an activation of the option button.

23. The method of claim 20, wherein the option button function setting step includes:

subscribing to interactive control services provided by the interactive control services provider;

providing interactive control services to the interactive control services subscriber;

consuming interactive control services provided by the interactive control services provider, and setting at least one of the function and status of the option button according to the consumed interactive control services.

24. The method of claim 23, wherein the interactive control services subscriber providing step and the non-video services subscriber providing step are carried out such that the interactive control services subscriber is independent of the non-video services subscriber.

25. The method of claim of claim 23, further comprising:

monitoring an activation state of the option button and, upon detecting that the option button has been activated, providing, by the interactive control services provider inside the gaming machine, interactive control services to the interactive control services subscriber executing in one of the plurality of computer nodes, indicating that the option button has been activated, and causing the interactive control services subscriber to communicate with the non-video services subscriber and the non-video services subscriber to consume non-video display services of the gaming machine to cause the non-video display provider to control the non-video display to update in accordance with the consumed non-video display services.

26. The method of claim 20, wherein the gaming machine providing step is carried out with the non-video display being disposed at least partially over the option button.

27. The method of claim 20, wherein the gaming machine providing step is carried out with the non-video display including an organic light emitting diode (OLED).

28. The method of claim 20, wherein the gaming machine providing step is carried out with the option button including a button housing and a button plunger, and with the non-video display being unattached to the button housing and unattached to the button plunger.

29. The method of claim 20, wherein the gaining machine providing step is carried out with the option button including a button plunger, and with the non-video display being attached to the button plunger.

30. The method of claim 20, wherein the gaming machine providing step is carried out with the gaming machine including a front panel plate, with the non-video display being attached to the front panel plate, and with the option button being disposed at least partially over the non-video display and including an at least partially transparent portion such that the non-video display is viewable therethrough.

31. The method of claim 20, wherein the gaming machine providing step is carried out with the gaming machine including a front panel plate and with the option button comprising leg portions that are configured to extend through openings defined in the front panel plate, the option button including a top portion that is at least partially transparent and with the non-video display being coupled to an underside of the top portion such that the non-video display is viewable therethrough.

32. The method of claim 20, further including a step of changing the function of the option button during game play of the game selected by the player.

33. The method of claim 20, wherein the non-video display services providing step, the subscribing step, the consuming step and the controlling step is carried out by a non-video display services provider that includes all necessary computer, electronics and software to subscribe to, provide and consume the non-video display services to and from the non-video services subscriber.

34. The method of claim 33, wherein the non-video display services provider is configured to subscribe to, provide and consume the non-video display services independently of a controller of the gaming machine.

* * * * *